US011626070B2

(12) United States Patent
Yun et al.

(10) Patent No.: US 11,626,070 B2
(45) Date of Patent: Apr. 11, 2023

(54) ORGANIC LIGHT EMITTING DIODE DISPLAY DEVICE PERFORMING A SENSING OPERATION

(71) Applicant: Samsung Display Co., Ltd., Yongin-Si (KR)

(72) Inventors: Suyeon Yun, Seoul (KR); Yoona Kim, Hwaseong-si (KR); Heesoon Jeong, Hwaseong-si (KR); Minsoo Kim, Seoul (KR); Sunghoon Kim, Seoul (KR); Young-Cheol Jeong, Hwaseong-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/550,349

(22) Filed: Dec. 14, 2021

(65) Prior Publication Data

US 2022/0199019 A1 Jun. 23, 2022

(30) Foreign Application Priority Data

Dec. 18, 2020 (KR) ..... 10-2020-0178989

(51) Int. Cl.
*G09G 3/3233* (2016.01)
*G09G 3/3266* (2016.01)

(52) U.S. Cl.
CPC ..... *G09G 3/3233* (2013.01); *G09G 3/3266* (2013.01); *G09G 2320/029* (2013.01); *G09G 2320/043* (2013.01)

(58) Field of Classification Search
None
See application file for complete search history.

(56) References Cited

U.S. PATENT DOCUMENTS

| | | | | |
|---|---|---|---|---|
| 9,318,055 | B2 | 4/2016 | Kim et al. | |
| 9,548,026 | B2 | 1/2017 | Jang | |
| 2019/0180691 | A1* | 6/2019 | Takasugi | G09G 3/3233 |
| 2020/0219451 | A1* | 7/2020 | Kim | G09G 3/3266 |
| 2022/0139325 | A1* | 5/2022 | Lee | G09G 3/3233 345/694 |
| 2022/0189407 | A1* | 6/2022 | Choi | G09G 3/3266 |

FOREIGN PATENT DOCUMENTS

| | | | |
|---|---|---|---|
| KR | 1020190066802 | A | 6/2019 |
| KR | 1020190081471 | A | 7/2019 |
| KR | 1020200072635 | A | 6/2020 |
| KR | 1020200076225 | A | 6/2020 |

* cited by examiner

*Primary Examiner* — Nitin Patel
*Assistant Examiner* — Amen W Bogale
(74) *Attorney, Agent, or Firm* — Cantor Colburn LLP

(57) ABSTRACT

An organic light emitting diode (OLED) display device includes: a display panel including a first region and a second region; and a scan driver including a plurality of first stages and a plurality of second stages which are coupled to each other. The plurality of first stages is configured to provide scan signals and sensing signals to the first region, and the plurality of second stages is configured to provide the scan signals and the sensing signals to the second region. A configuration of the plurality of first stages is different from a configuration of the plurality of second stages.

19 Claims, 15 Drawing Sheets

ORGANIC LIGHT EMITTING DIODE DISPLAY DEVICE PERFORMING A SENSING OPERATION

This application claims priority to Korean Patent Application No. 10-2020-0178989, filed on Dec. 18, 2020, and all the benefits accruing therefrom under 35 U.S.C. § 119, the content of which in its entirety is herein incorporated by reference.

BACKGROUND

1. Field

Embodiments of the present inventive concept relate to a display device, and more particularly to an organic light emitting diode ("OLED") display device performing a sensing operation.

2. Description of the Related Art

As an organic light emitting diode (OLED) display device operates over time, driving transistors and/or OLEDs of a plurality of pixels included in the OLED display device may be degraded over time. To compensate for the degradation of the driving transistors and/or the OLEDs, the OLED display device may perform a sensing operation that senses characteristics of the driving transistors and/or the OLEDs of the plurality of pixels. However, since a conventional OLED display device performs a sensing operation for entire pixels included in the conventional OLED display device, it may take a long sensing time to perform the sensing operation.

SUMMARY

Some embodiments provide an organic light emitting diode ("OLED") display device capable of efficiently performing a sensing operation.

According to embodiments, there is provided an OLED display device including: a display panel including a first region and a second region; and a scan driver including a plurality of first stages and a plurality of second stages which are coupled to each other. The plurality of first stages is configured to provide scan signals and sensing signals to the first region, and the plurality of second stages is configured to provide the scan signals and the sensing signals to the second region. A configuration of the plurality of first stages is different from a configuration of the plurality of second stages.

In embodiments, the first region may be a degradation vulnerable region having a relatively high degradation degree, and the second region may be a normal region having a relatively low degradation degree.

In embodiments, the first region may be an upper region or a lower region of the display panel, and the second region may be a middle region between the upper region and the lower region of the display panel.

In embodiments, each of a plurality of pixels included in the first and second regions may include a capacitor including a first electrode coupled to a gate node, and a second electrode coupled to a source node, a first transistor which generates a driving current based on a voltage stored in the capacitor, a second transistor which couples a data line to the gate node in response to a corresponding one of the scan signals, a third transistor which couples a sensing line to the source node in response to a corresponding one of the sensing signals, and an OLED which emits light based on the driving current.

In embodiments, in a sensing period of each frame period, a sensing operation for each pixel of the first region may be performed, and a sensing operation for one pixel among N*M pixels of the second region may be performed, where N is an integer greater than 1, and M is an integer greater than 0.

In embodiments, each frame period may include an active period and a sensing period. In the active period, the plurality of first stages and the plurality of second stages may provide the scan signals and the sensing signals to all of pixel rows of the first region and all of pixel rows of the second region. In the sensing period, the plurality of first stages may provide the scan signals and the sensing signals to all of the pixel rows of the first region, and the plurality of second stages may provide the scan signals and the sensing signals to only a portion of the pixel rows of the second region.

In embodiments, in the sensing period, the plurality of second stages may provide the scan signals and the sensing signals to one pixel row per N pixel rows of the second region, where N is an integer greater than 1.

In embodiments, two stages of the plurality of first stages may share one selective sensing input circuit, and 2N stages of the plurality of second stages may share one selective sensing input circuit, where N is an integer greater than 1.

In embodiments, each of the plurality of first stages and the plurality of second stages may include a control node input circuit which transfers a first previous carry signal to a control node in response to the first previous carry signal, and transfers a low voltage to the control node in response to a next carry signal, an inverter circuit which performs an inverting operation such that the control node and an inverted control node have opposite voltages, a carry output circuit which outputs a carry signal based on a voltage of the control node and a carry clock signal, a sensing output circuit which outputs a corresponding one of the sensing signals based on the voltage of the control node and a sensing clock signal, a scan output circuit which outputs a corresponding one of the scan signals based on the voltage of the control node and a scan clock signal, and a selective sensing circuit which transfers a high voltage to the control node based on a sensing start signal and a voltage of a selective sensing input node. Two stages of the plurality of first stages may further include one selective sensing input circuit which provides a second previous carry signal to the selective sensing input nodes of the two stages, and 2N stages of the plurality of second stages may further include one selective sensing input circuit which provides a third previous carry signal to the selective sensing input nodes of the 2N stages, where N is an integer greater than 1.

In embodiments, two stages of the plurality of first stages may share one selective sensing input circuit, the scan driver may further include an extension switch which couples selective sensing input nodes of 2N stages of the plurality of second stages to each other in response to an extension signal, where N is an integer greater than 1, and the 2N stages of the plurality of second stages may share one selective sensing input circuit via the extension switch.

In embodiments, each of the plurality of first stages may include one selective sensing input circuit, and N stages of the plurality of second stages may share one selective sensing input circuit, where N is an integer greater than 1.

In embodiments, each of the plurality of first stages and the plurality of second stages may include a control node input circuit which transfers a first previous carry signal to a control node in response to the first previous carry signal, and transfers a low voltage to the control node in response to a next carry signal, an inverter circuit which performs an inverting operation such that the control node and an inverted control node have opposite voltages, a carry output circuit which outputs a carry signal based on a voltage of the control node and a carry clock signal, a sensing output circuit which outputs a corresponding one of the sensing signals based on the voltage of the control node and a sensing clock signal, a scan output circuit which outputs a corresponding one of the scan signals based on the voltage of the control node and a scan clock signal, and a selective sensing circuit which transfers a high voltage to the control node based on a sensing start signal and a voltage of a selective sensing input node. Each of the plurality of first stages may further include one selective sensing input circuit which provides a second previous carry signal to the selective sensing input node of the first stage, and N stages of the plurality of second stages may further include one selective sensing input circuit which provides a third previous carry signal to the selective sensing input nodes of the N stages, where N is an integer greater than 1.

In embodiments, each of the plurality of first stages may include one selective sensing input circuit, the scan driver may further include an extension switch which couples selective sensing input nodes of N stages of the plurality of second stages to each other in response to an extension signal, where N is an integer greater than 1, and the N stages of the plurality of second stages may share one selective sensing input circuit via the extension switch.

According to embodiments, there is provided an OLED display device including: a display panel including a first region and a second region; and a scan driver including a plurality of first stages and a plurality of second stages which are coupled to each other. The plurality of first stages is configured to provide scan signals and sensing signals to the first region, and the plurality of second stages is configured to provide the scan signals and the sensing signals to the second region. Two stages of the plurality of first stages share one selective sensing input circuit, and 2N stages of the plurality of second stages share one selective sensing input circuit, where N is an integer greater than 1.

In embodiments, the first region may be a degradation vulnerable region having a relatively high degradation degree, and the second region may be a normal region having a relatively low degradation degree.

In embodiments, the first region may be an upper region or a lower region of the display panel, and the second region may be a middle region between the upper region and the lower region of the display panel.

In embodiments, in a sensing period of each frame period, a sensing operation for each pixel of the first region may be performed, and a sensing operation for one pixel among N*M pixels of the second region may be performed, where N is an integer greater than 1, and M is an integer greater than 0.

According to embodiments, there is provided an OLED display device including: a display panel including a first region and a second region; and a scan driver including a plurality of first stages and a plurality of second stages which are coupled to each other The plurality of first stages is configured to provide scan signals and sensing signals to the first region, and the plurality of second stages is configured to provide the scan signals and the sensing signals to the second region. Each of the plurality of first stages includes one selective sensing input circuit, and N stages of the plurality of second stages share one selective sensing input circuit, where N is an integer greater than 1.

In embodiments, the first region may be a degradation vulnerable region having a relatively high degradation degree, and the second region may be a normal region having a relatively low degradation degree.

In embodiments, the first region may be an upper region or a lower region of the display panel, and the second region may be a middle region between the upper region and the lower region of the display panel.

As described above, in an OLED display device according to embodiments, a configuration of a plurality of first stages providing scan signals and sensing signals to a first region (e.g., a degradation vulnerable region) of a display panel may be different from a configuration of a plurality of second stages providing the scan signals and the sensing signals to a second region (e.g., a normal region) of the display panel. Accordingly, a sensing operation for the first region (e.g., the degradation vulnerable region) may be performed more finely (or minutely) compared with a sensing operation for the second region (e.g., the normal region), and a size of a scan driver and power consumption of the OLED display device may be effectively reduced.

BRIEF DESCRIPTION OF THE DRAWINGS

Illustrative, non-limiting embodiments will be more clearly understood from the following detailed description in conjunction with the accompanying drawings.

DETAILED DESCRIPTION

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein. The terminology used herein is for the purpose of describing particular embodiments only and is not intended to be limiting. As used herein, the singular forms "a," "an," and "the" are intended to include the plural forms, including "at least one," unless the content clearly indicates otherwise. "At least one" is not to be construed as limiting "a" or "an." "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof. Hereinafter, embodiments of the present inventive concept will be explained in detail with reference to the accompanying drawings.

Figure 1:
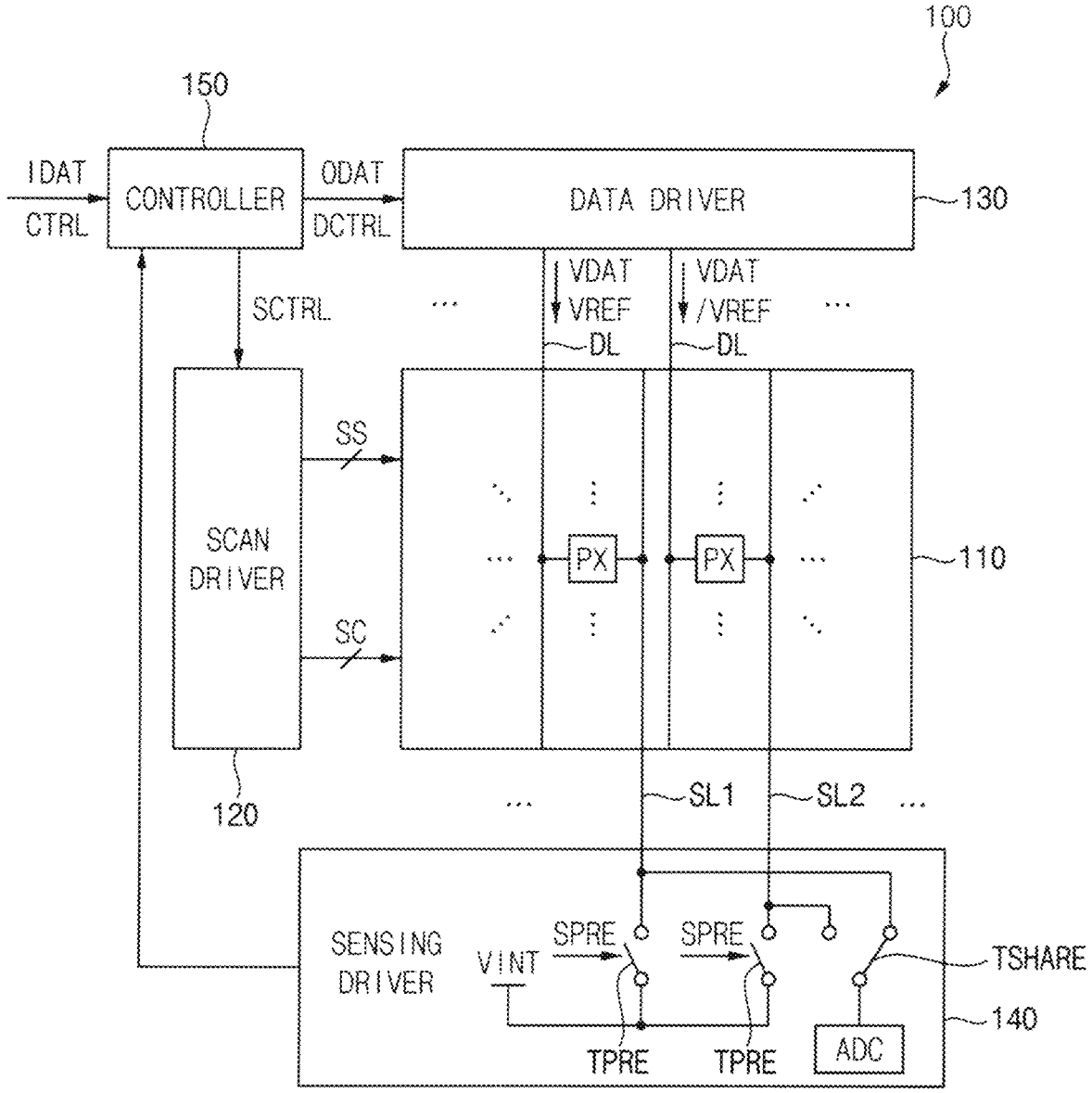
FIG. 1 is a block diagram illustrating an organic light emitting diode (OLED) display device according to embodiments.
Figure 2:
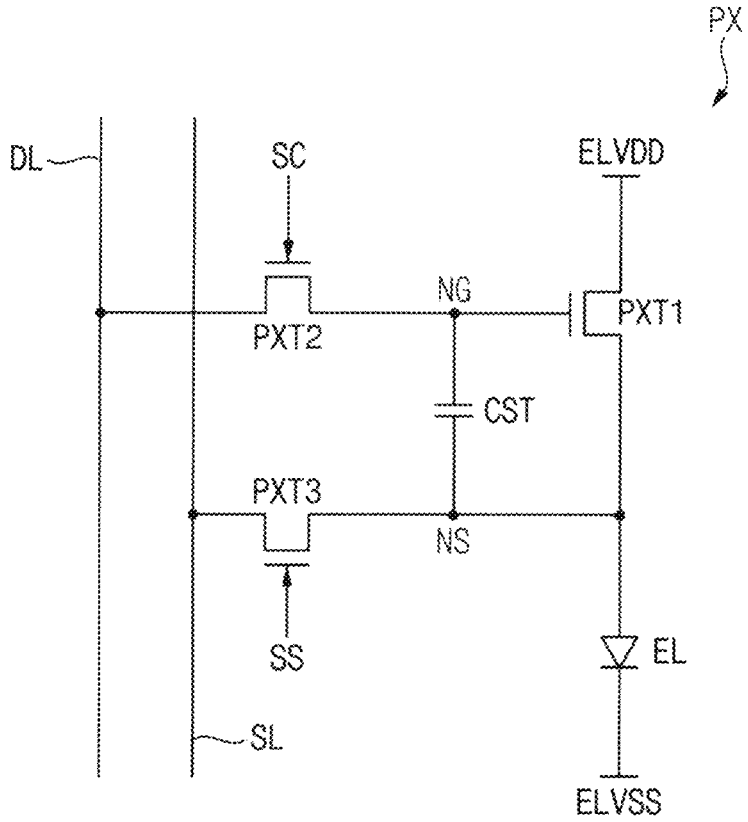
FIG. 2 is a circuit diagram illustrating an example of a pixel included in an OLED display device according to embodiments.
Figure 3:
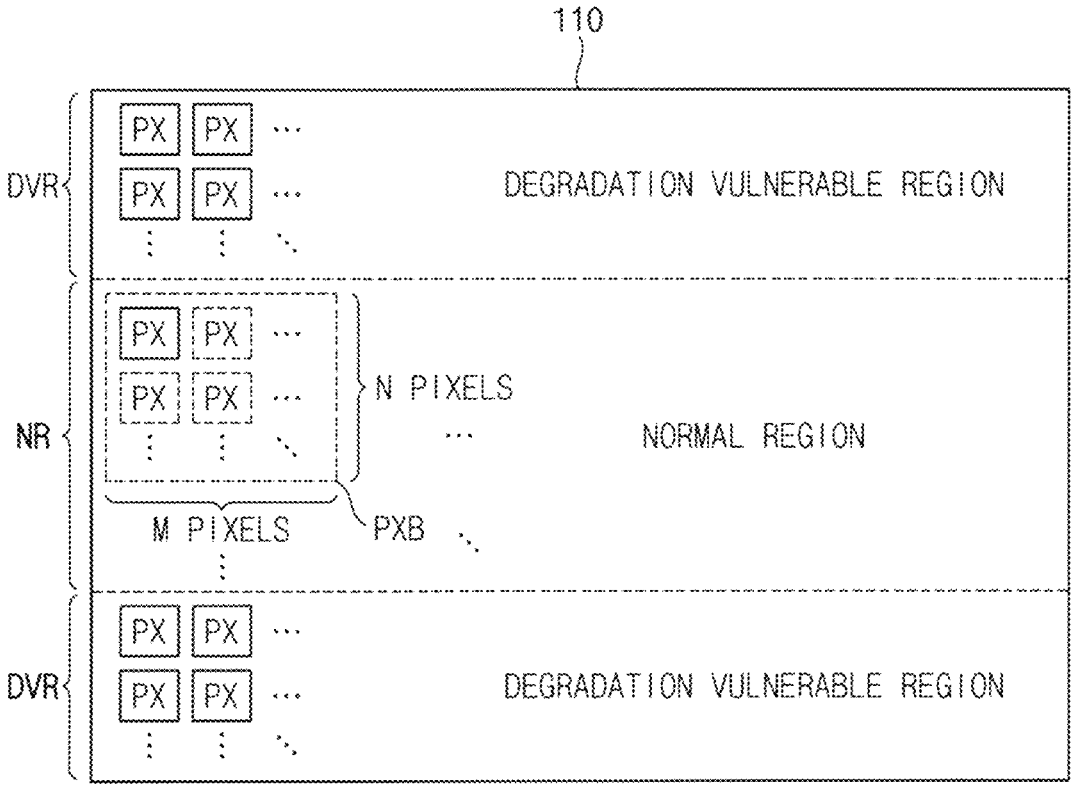
FIG. 3 is a diagram illustrating an example of a display panel including a degradation vulnerable region and a normal region.
Figure 4:
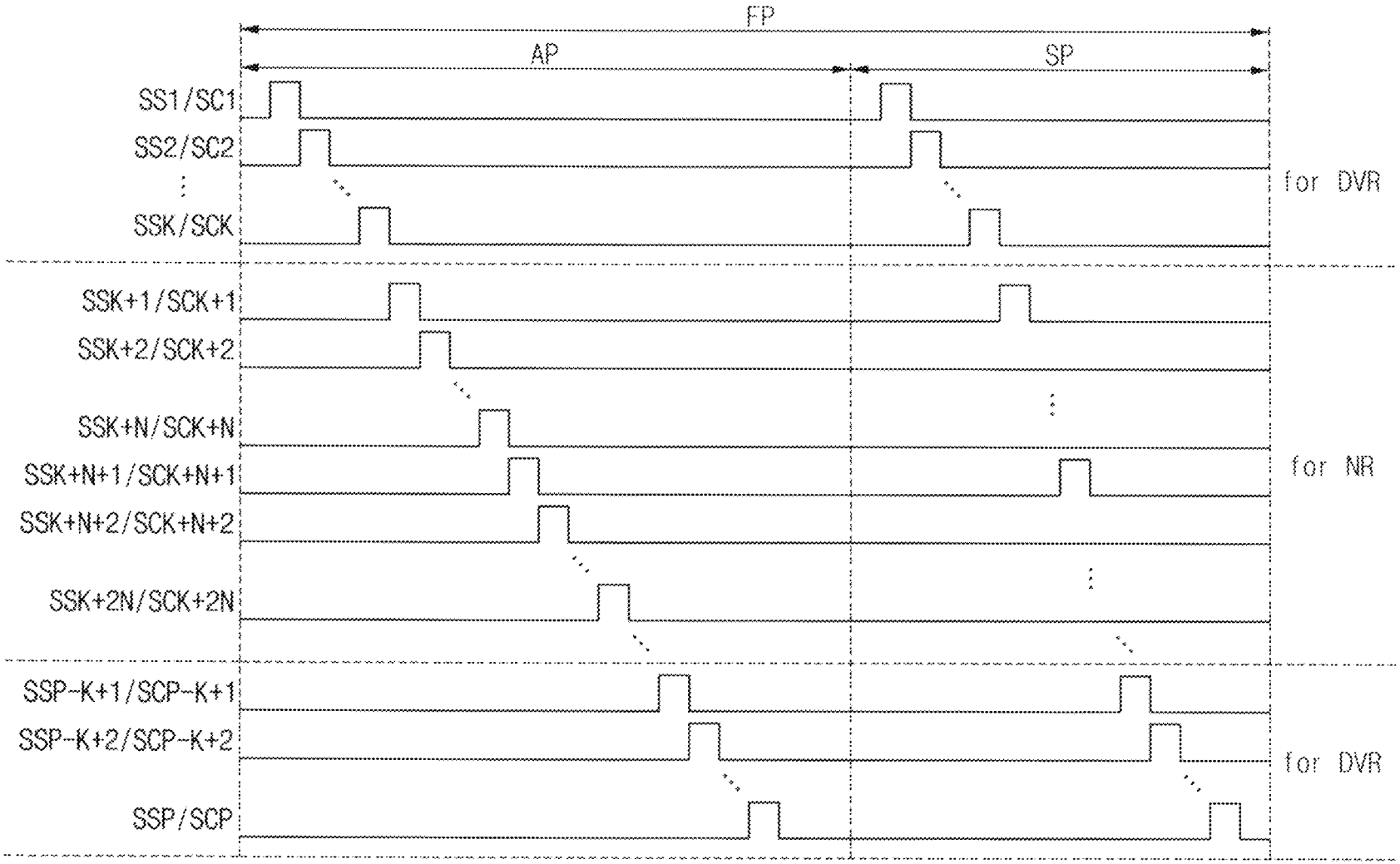
FIG. 4 is a timing diagram for describing an example of an operation of a scan driver providing scan signals and sensing signals to a display panel of FIG. 3.
Figure 5:
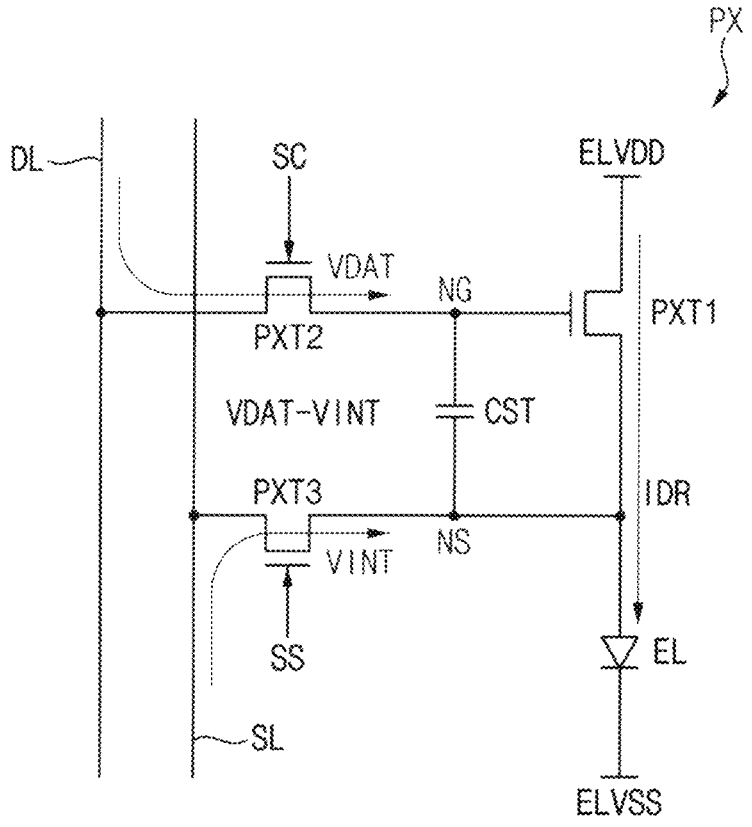
FIG. 5 is a circuit diagram for describing an example of an operation of each pixel in an active period.
Figure 6A:
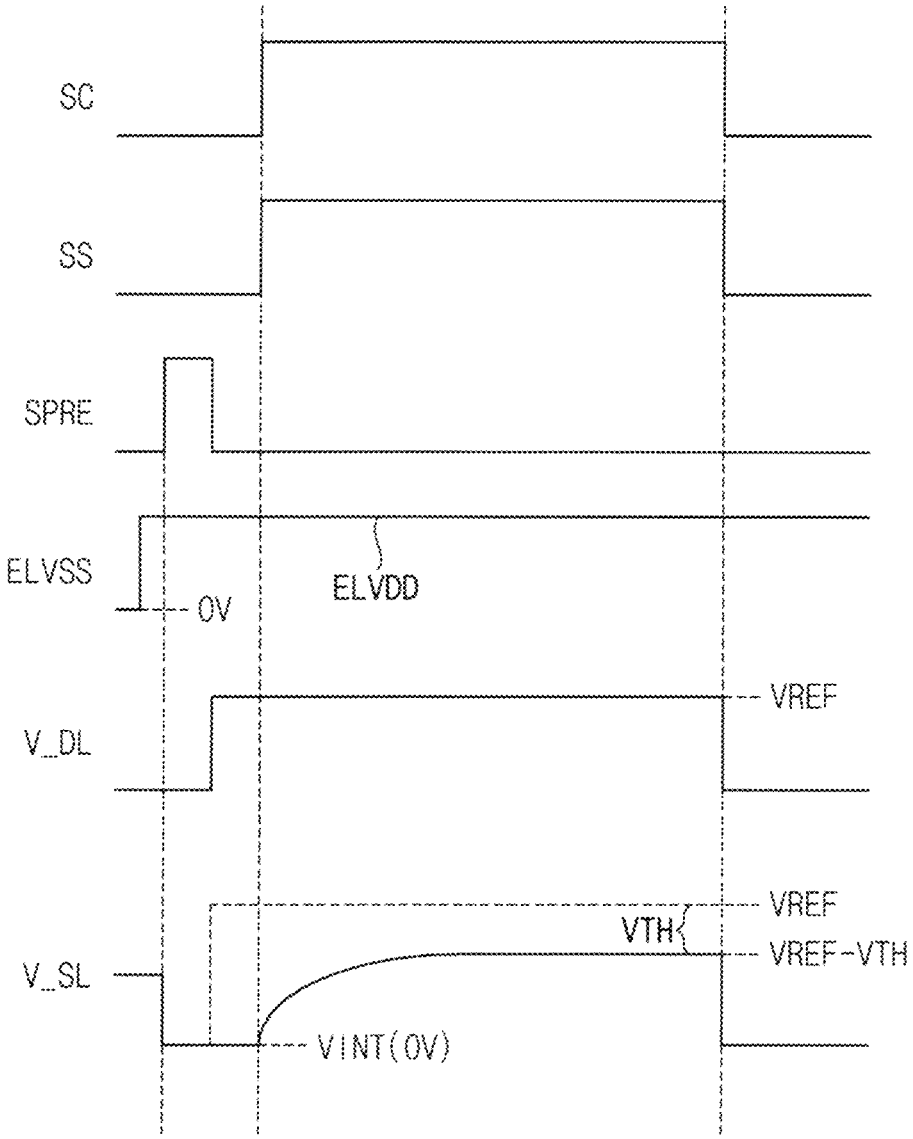
FIG. 6A is a timing diagram for describing an example of a sensing operation for a pixel in a sensing period.
Figure 6B:
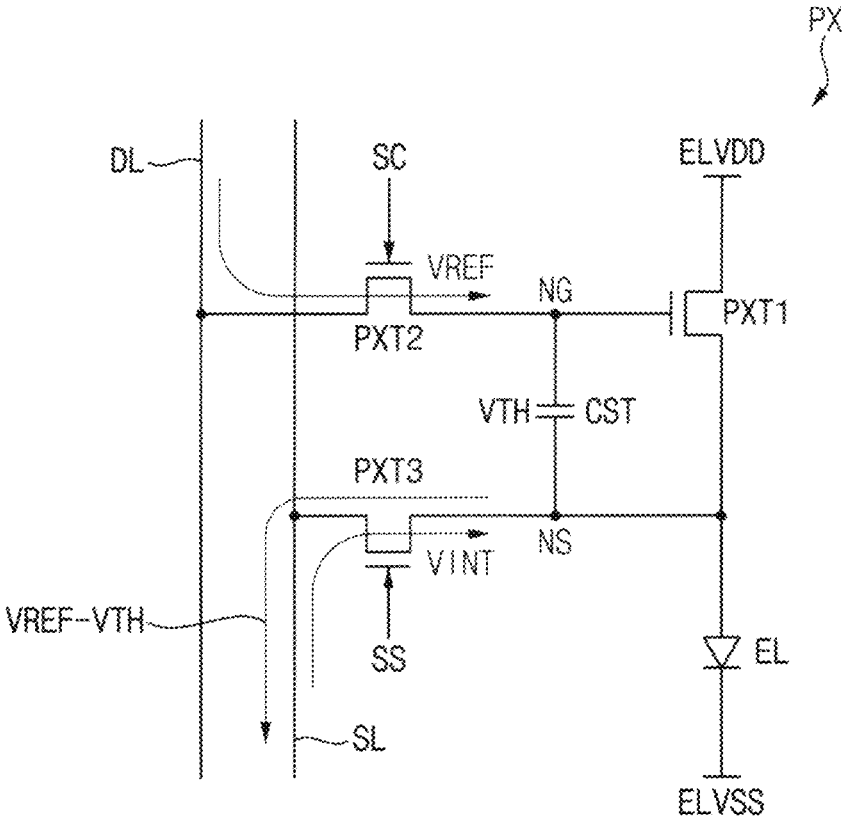
FIG. 6B is a circuit diagram for describing the example of the sensing operation for the pixel in the sensing period.

FIG. 1 is a block diagram illustrating an organic light emitting diode ("OLED") display device according to embodiments, FIG. 2 is a circuit diagram illustrating an example of a pixel included in an OLED display device according to embodiments, FIG. 3 is a diagram illustrating an example of a display panel including a degradation vulnerable region and a normal region, FIG. 4 is a timing diagram for describing an example of an operation of a scan driver providing scan signals and sensing signals to a display panel of FIG. 3, FIG. 5 is a circuit diagram for describing an example of an operation of each pixel in an active period, FIG. 6A is a timing diagram for describing an example of a sensing operation for a pixel in a sensing period, and FIG. 6B is a circuit diagram for describing the example of the sensing operation for the pixel in the sensing period.

Referring to FIG. 1, an OLED display device 100 according to embodiments may include a display panel 110, a scan driver 120, a data driver 130, a sensing driver 140 and a controller 150.

The display panel 110 may include a plurality of data lines DL, a plurality of sensing lines SL1 and SL2, and a plurality of pixels PX coupled to the plurality of data lines DL and the plurality of sensing lines SL1 and SL2. In some embodiments, the display panel 110 may further include a plurality of sensing signal lines for transferring sensing signals SS to the plurality of pixels PX, and a plurality of scan signal lines for transferring scan signals SC to the plurality of pixels PX. In some embodiments, each pixel PX may include an organic light emitting diode (OLED), and the display panel 110 may be an OLED panel.

In an embodiment, for example, as illustrated in FIG. 2, each pixel PX may include a capacitor CST, a first transistor PXT1, a second transistor PXT2, a third transistor PXT3 and an organic light emitting diode EL.

The capacitor CST may store a data voltage VDAT transferred through the data line DL. The capacitor CST may be referred to as a storage capacitor for storing the data voltage VDAT. In some embodiments, the capacitor CST may include a first electrode coupled to a gate node NG, and a second electrode coupled to a source node NS.

The first transistor PXT1 may generate a driving current based on the data voltage VDAT stored in the capacitor CST. The first transistor PXT1 may be referred to as a driving transistor for driving the organic light emitting diode EL. In some embodiments, the first transistor PXT1 may include a gate coupled to the gate node NG, a drain receiving a first power supply voltage ELVDD (e.g., a high power supply voltage), and a source coupled to the source node NS.

The second transistor PXT2 may couple the data line DL to the gate node NG in response to the scan signal SC. Thus, the second transistor PXT2 may transfer the data voltage VDAT or a reference voltage VREF received from the data line DL to the gate node NG (i.e., the first electrode of the capacitor CST) in response to the scan signal SC. The second transistor PXT2 may be referred to as a switching transistor or a scan transistor. In some embodiments, the second transistor PXT2 may include a gate receiving the scan signal SC, a drain coupled to the data line DL, and a source coupled to the gate node NG.

The third transistor PXT3 may couple the sensing line SL to the source node NS in response to the sensing signal SS. Thus, the third transistor PXT3 may transfer an initialization voltage VINT of the sensing line SL in response to the sensing signal SS, or may transfer a voltage or a current at the source node NS to the sensing driver 140 through the sensing line SL. The third transistor PXT3 may be referred to as a sensing transistor. In some embodiments, the third transistor PXT3 may include a gate receiving the sensing signal SS, a drain coupled to the source node NS, and a source coupled to the sensing line SL.

The organic light emitting diode EL may emit light based on the driving current generated by the first transistor PXT1. In some embodiments, the organic light emitting diode EL may include an anode coupled to the source node NS, and a cathode receiving a second power supply voltage ELVSS (e.g., a low power supply voltage).

In some embodiments, as illustrated in FIG. 2, the first transistor PXT1, the second transistor PXT2 and the third transistor PXT3 may be implemented with, but not be limited to, NMOS transistors. Further, a configuration of the pixel PX according to embodiments may not be limited to the example of FIG. 2. In other embodiments, the display panel 110 may be an inorganic light emitting diode display panel, a quantum dot light emitting diode display panel, a liquid crystal display ("LCD") panel, or any other suitable display panel.

The scan driver 120 may provide the scan signals SC and the sensing signals SS to the plurality of pixels PX based on a scan control signal SCTRL received from the controller 150. The scan control signal SCTRL according to the invention may include, but not be limited to, a scan clock signal, a sensing clock signal and a carry clock signal. In some embodiments, the scan control signal SCTRL may further include a sensing start signal and a sensing end signal for each stage. In some embodiments, the scan driver 120 may be integrated or disposed in a peripheral portion of the display panel 110. In other embodiments, the scan driver 120 may be implemented with one or more integrated circuits.

The data driver 130 may generate the data voltages VDAT based on output image data ODAT and a data control signal DCTRL received from the controller 150, and may provide the data voltages VDAT to the plurality of pixels PX through the plurality of data lines DL. In some embodiments, the data control signal DCTRL according to the invention may include, but not be limited to, an output data enable signal, a horizontal start signal and a load signal. Further, in some embodiments, data driver 130 may provide the reference voltage VREF through the plurality of data lines DL in a sensing period. In some embodiments, the data driver 130 and the sensing driver 140 may be implemented with at least one single integrated circuit, and the single integrated circuit including the data driver 130 and the sensing driver 140 may be referred to as a readout-source driver integrated circuit ("RSIC"). In other embodiments, the data driver 130 and the controller 150 may be implemented with at least one single integrated circuit, and the single integrated circuit including the data driver 130 and the controller 150 may be referred to as a timing controller embedded data driver ("TED") integrated circuit. In still other embodiments, the data driver 130, the sensing driver 140 and the controller 150 may be implemented with separate integrated circuits.

The sensing driver 140 may be coupled to the plurality of sensing lines SL1 and SL2 of the display panel 110, and may sense characteristics of the plurality of pixels PX, for example, driving characteristics (e.g., threshold voltages VTH and/or mobility) of the first transistors PXT1 of the plurality of pixels PX through the plurality of sensing lines SL1 and SL2. In some embodiments, the sensing driver 140 may include one or more precharge switches TPRE that transfer the initialization voltage VINT to the sensing lines SL1 and SL2 in response to a precharge signal SPRE, and one or more analog-to-digital converters ADC that convert the characteristics of the plurality of pixels PX sensed through the sensing lines SL1 and SL2 into digital sensing data. The sensing driver 140 may provide the digital sensing data representing the characteristics of the plurality of pixels PX to the controller 150. In some embodiments, the sensing driver 140 may include one analog-to-digital converter ADC per each sensing line SL1 and SL2. In other embodiments, the sensing driver 140 may include one analog-to-digital converter ADC per two or more sensing lines SL1 and SL2, and the sensing driver 140 may further include a sharing switch TSHARE that couples one of the two or more sensing lines SL1 and SL2 to the one analog-to-digital converter ADC. In this case, the sensing driver 140 may sense characteristics of two or more pixels PX coupled to the two or more sensing lines SL1 and SL2 in a time-division manner.

The controller 150 (e.g., a timing controller ("TCON")) may receive input image data IDAT and a control signal CTRL from an external host processor (e.g., a graphic processing unit ("GPU"), an application processor ("AP") or a graphic card). In some embodiments, the input image data IDAT may be image data including red image data, green image data and blue image data. In some embodiments, the control signal CTRL according to the invention may include, but not be limited to, a vertical synchronization signal, a horizontal synchronization signal, an input data enable signal, a master clock signal, etc. The controller 150 may receive the digital sensing data representing the characteristics of the plurality of pixels PX from the sensing driver 140, and may generate the output image data ODAT by correcting the input image data IDAT based on the digital sensing data. The data voltages VDAT generated based on the output image data ODAT may compensate for degradation of the plurality of pixels PX, or degradation of the first transistors PXT1 of the plurality of pixels PX. Further, the controller 150 may control an operation of the scan driver 120 by providing the scan control signal SCTRL to the scan driver 120, and may control an operation of the data driver 130 by providing the output image data ODAT and the data control signal DCTRL to the data driver 130.

A conventional OLED display device may perform a sensing operation for entire pixels, and thus it may take a long sensing time to perform the sensing operation. However, in the OLED display device 100 according to embodiments, in a sensing period of each frame period, a sensing operation for each pixel PX of a first region is performed with respect to the first region of the display panel 110, and a sensing operation for one pixel PX among N*M pixels of a second region is performed with respect to the second region of the display panel 110, where N is an integer greater than 1, and M is an integer greater than 0.

In some embodiments, the first region on which the sensing operation for each pixel PX is performed in the sensing period may be a degradation vulnerable region having a relatively high degradation degree, and the second region on which the sensing operation for the one pixel PX among the N*M pixels is performed in the sensing period may be a normal region having a relatively low degradation degree. For example, in a case where the OLED display device 100 is a monitor, a fixed image may be mainly displayed in an upper region (or a top region) or a lower region (or a bottom region) of the display panel 110, and the upper region and the lower region may be degraded more faster than the remaining region of the display panel 110. Accordingly, as illustrated in FIG. 3, the upper region and the lower region of the display panel 110 may be the degradation vulnerable region DVR having the relatively high degradation degree, and a middle region between the upper region and the lower region of the display panel 110 may be the normal region NR having the relatively low degradation degree. In this case, in the sensing period, the OLED display device 100 may perform the sensing operation for each pixel PX with respect to the degradation vulnerable region DVR (e.g., the upper region and/or the lower region) of the display panel 110. Further, the OLED display device 100 may group the plurality of pixels PX into pixel blocks PXB with respect to the normal region NR (e.g., the middle region) of the display panel 110, and may perform the sensing operation for one pixel PX per each pixel block PXB in the sensing period. For example, each pixel block PXB may include N*M pixels PX located in N pixel rows and M pixel columns, where N is an integer greater than 1, and M is an integer greater than 0.

To perform the sensing operation for each pixel PX of the degradation vulnerable region DVR and the sensing operation for each pixel block PXB of the normal region NR, in the sensing period, the scan driver 120 of the OLED display device 100 according to embodiments may provide the scan signals SC and the sensing signals SS to all of pixel rows of the degradation vulnerable region DVR, and may provide the scan signals SC and the sensing signals SS to a portion of pixel rows of the normal region NR. For example, as illustrated in FIG. 4, each frame period FP of the OLED display device 100 may include an active period AP and a sensing period SP. In some embodiments, the sensing period SP may correspond to a vertical blank period between the active periods AP.

In the active period AP, the scan driver 120 may sequentially provide the scan signals SC and the sensing signals SS to all of the pixel rows of the degradation vulnerable region DVR and all of the pixel rows of the normal region NR. For example, in a case where the display panel 110 includes P pixel rows (i.e., first through P-th pixel rows), where P is an integer greater than 1, the scan driver 120 may sequentially provide first through P-th scan signals SC1 through SCP and first through P-th sensing signals SS1 through SSP to the first through P-th pixel rows of the display panel 110 on a pixel row basis in the active period AP.

FIG. 5 illustrates an example of an operation of the pixel PX in the active period AP. As illustrated in FIG. 5, in the active period AP, the second transistor PXT2 may transfer the data voltage VDAT of the data line DL to the gate node NG in response to the scan signal SC, and the third transistor PXT3 may transfer the initialization voltage VINT (e.g., a ground voltage) received from the sensing line SL to the source node NS in response to the sensing signal SS. The capacitor CST may store the data voltage VDAT (or a difference between the data voltage VDAT and the initialization voltage VINT), the first transistor PXT1 may generate the driving current IDR based on the data voltage VDAT stored in the capacitor CST, and the organic light emitting diode EL may emit light based on the driving current IDR generated by the first transistor PXT1.

In the sensing period SP, the scan driver 120 may provide the scan signals SC1 through SCK and SCP-K+1 through SCP and sensing signals SS1 through SSK and SSP-K+1 through SSP to all of the pixel rows of the degradation vulnerable region DVR, and may provide the scan signals SCK+1, SCK+N+1, . . . and the sensing signals SSK+1, SSK+N+1, . . . to a portion of the pixel rows of the normal region NR. For example, K pixel rows in the upper region and K pixel rows in the lower region of the display panel 110, or first through K-th pixel rows and (P−K+1)-th through P-th pixel rows may be the degradation vulnerable region DVR, where K is an integer greater than 0 and less than or equal to P. In the sensing period SP, the scan driver 120 may sequentially provide first through K-th scan signals SC1 through SCK and first through K-th sensing signals SS1 through SSK to the first through K-th pixel rows on a pixel row basis, and may sequentially provide (P−K+1)-th through P-th scan signals SCP−K+1 through SCP and (P−K+1)-th through P-th sensing signals SSP−K+1 through SSP to the (P−K+1)-th through P-th pixel rows on a pixel row basis. Further, with respect to the normal region NR of the display panel 110 (i.e., (K+1)-th through (P−K)-th pixel rows), the scan driver 120 may provide the scan signal SCK+1, SCK+N+1, . . . and the sensing signal SSK+1, SSK+N+1, . . . to one pixel row per N pixel rows in the sensing period SP, where N is an integer greater than 1. For example, in the sensing period SP, the scan driver 120 may provide the scan signal SCK+1 and the sensing signal SSK+1 only to pixels in a (K+1)-th pixel row among (K+1)-th through (K+N)-th pixel rows, and may provide the scan signal SCK+N+1 and the sensing signal SSK+N+1 only to pixels in a (K+N+1)-th pixel row among (K+N+1)-th through (K+2N)-th pixel rows. Accordingly, in the sensing period SP, the sensing operation may be performed on the one pixel row per the N pixel rows of the normal region NR, and thus the entire sensing time and power consumption of the OLED display device 100 may be effectively reduced. Further, in some embodiments, with respect to the normal region NR, the sensing operation may be performed on one pixel PX per consecutive M pixels PX in the one pixel row. Thus, the sensing operation may be performed on one pixel PX per each pixel block PXB including N*M pixels PX. In this case, the entire sensing time and the power consumption of the OLED display device 100 may be effectively reduced.

FIG. 6A illustrates an example of signals/voltages for each pixel PX on which the sensing operation is performed in the sensing period SP, and FIG. 6B illustrates an example of an operation of the pixel PX on which the sensing operation is performed. As illustrated in FIGS. 6A and 6B, in the sensing period SP, the second power supply voltage ELVSS may be changed from a low voltage level, for example about 0V, to a voltage level of the first power supply voltage ELVDD. In this case, the plurality of pixels PX may not emit light in the sensing period SP. Before the scan and sensing signals SC and SS are applied to the pixel PX, the sensing driver 140 may provide the initialization voltage VINT (e.g., of about 0V) to the sensing line SL in response to the precharge signal SPRE, and may precharge a voltage V_SL of the sensing line SL to the initialization voltage VINT. The data driver 130 may provide the reference voltage VREF as a voltage V_DL of the data line DL. If the scan and sensing signals SC and SS are applied to the pixel PX, the second transistor PXT2 may transfer the reference voltage VREF of the data line DL to the gate node NG in response to the scan signal SC, and the third transistor PXT3 may transfer the initialization voltage VINT of the sensing line SL to the source node NS in response to the sensing signal SS. While the scan and sensing signals SC and SS are applied to the pixel PX, the first transistor PXT1 may be turned on based on the reference voltage VREF at the gate node NG, and a voltage of the source node NS may be increased to a voltage VREF-VTH corresponding to the threshold voltage VTH of the first transistor PXT1 subtracted from the reference voltage VREF. The voltage VREF-VTH of the source node NS may be provided to the sensing driver 140 through the third transistor PXT3 and the sensing line SL, and the sensing driver 140 may sense the threshold voltage VTH of the first transistor PXT1 by measuring the voltage VREF-VTH of the source node NS.

Figure 7:
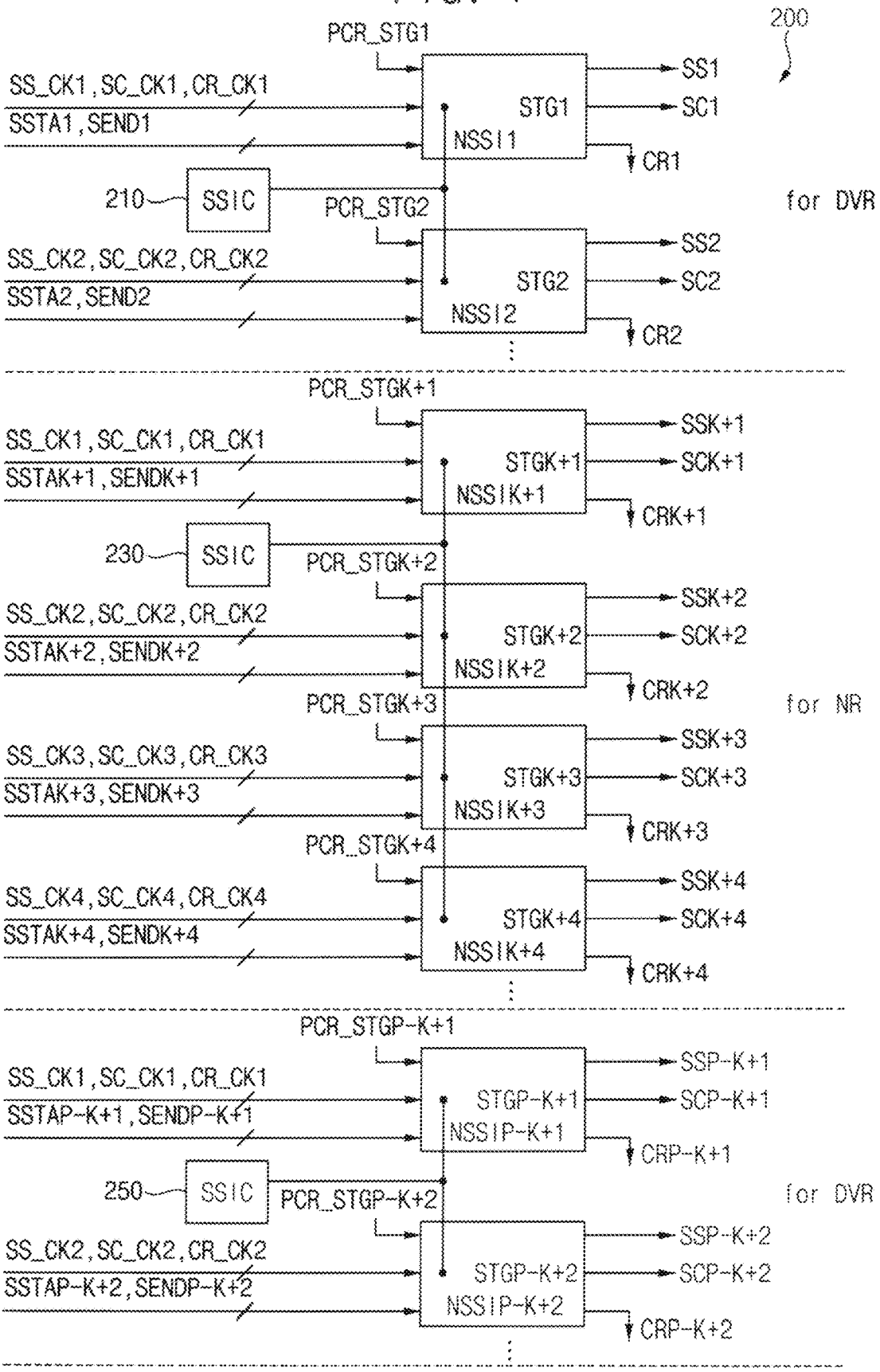
FIG. 7 is a block diagram illustrating a scan driver according to embodiments.
Figure 11:
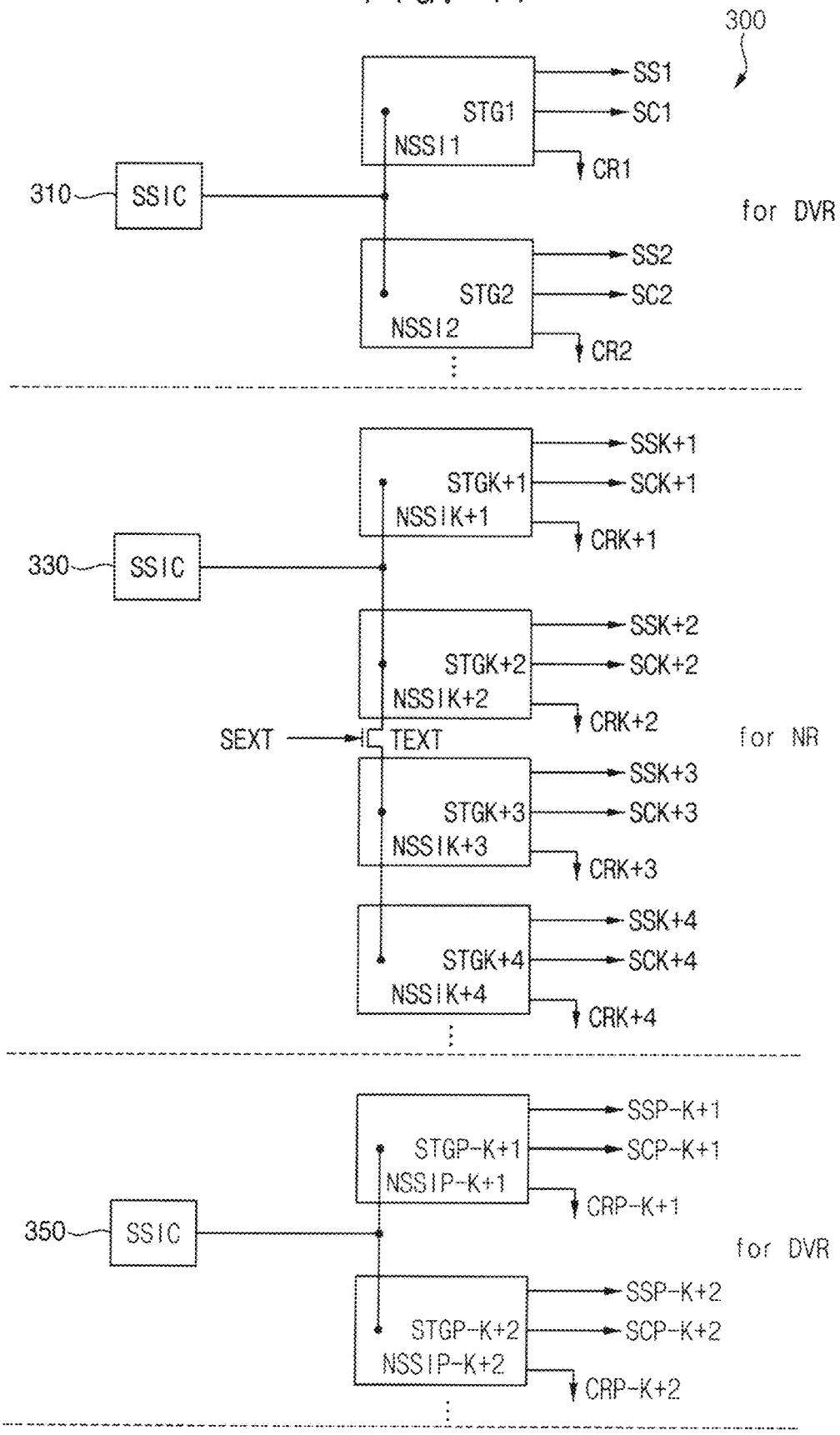
FIG. 11 is a block diagram illustrating a scan driver according to another embodiment.

To generate the scan signals SC1 through SCP and the sensing signals SS1 through SSP illustrated in FIG. 4, the scan driver 120 of the OLED display device 100 according to embodiments may include a plurality of first stages and a plurality of second stages that are coupled to each other. The plurality of first stages may provide the scan signals SC1, SC2, . . . , SCK, and SCP−K+1, SCP−K+2, SCP and the sensing signals SS1, SS2, . . . , SSK, and SSP−K+1, SSP−K+2, . . . , SSP to the first region (e.g., the degradation vulnerable region DVR), and the plurality of second stages may provide the scan signals SCK+1, SCK+2, . . . , SCK+N, SCK+N+1 . . . and the sensing signals SSK+1, SSK+2, . . . , SSK+N, SSK+N+1 . . . to the second region (e.g., the normal region NR). In some embodiments, a configuration of the plurality of first stages providing the scan signals SC1, SC2, . . . , SCK, and SCP−K+1, SCP−K+2, SCP and the sensing signals SS1, SS2, SSK, and SSP−K+1, SSP−K+2, . . . , SSP to the first region (e.g., the degradation vulnerable region DVR) may be different from a configuration of the plurality of second stages providing the scan signals SCK+1, SCK+2, . . . , SCK+N, SCK+N+1 and the sensing signals SSK+1, SSK+2, . . . , SSK+N, SSK+N+1 to the second region (e.g., the normal region NR). In some embodiments, as illustrated in FIG. 7 or FIG. 11, two stages of the plurality of first stages may share one selective sensing input circuit SSIC (See FIG. 9), and 2N stages of the plurality of second stages share one selective sensing input circuit SSIC, where N is an integer greater than 1. In other embodiments, each of the plurality of first stages may include one selective sensing input circuit SSIC, and N stages of the plurality of second stages may share one selective sensing input circuit SSIC, where N is an integer greater than 1. Accordingly, since N second stages or 2N second stages for the normal region NR may share one selective sensing input circuit SSIC, a size of the scan driver 120 of the OLED display device 100 according to embodiments may be effectively reduced compared with a size of a scan driver where each stage includes one selective sensing input circuit.

As described above, in the OLED display device 100 according to embodiments, the sensing operation may be performed on each pixel PX of the degradation vulnerable region DVR, and the sensing operation may be performed on one pixel PX per each pixel block PXB of the normal region NR. Further, in the OLED display device 100 according to embodiments, the configuration of the plurality of first stages providing the scan signals SC1, SC2, . . . , SCK, and SCP−K+1, SCP−K+2, . . . , SCP and the sensing signals SS1, SS2, . . . , SSK, and SSP−K+1, SSP−K+2, . . . , SSP to the first region (e.g., the degradation vulnerable region DVR) of the display panel 110 may be different from the configuration of the plurality of second stages providing the scan signals SCK+1, SCK+2, . . . , SCK+N, SCK+N+1 and the sensing signals SSK+1, SSK+2, . . . , SSK+N, SSK+N+1 to the second region (e.g., the normal region NR) of the display panel 110. Accordingly, in the OLED display device 100 according to embodiments, the sensing operation for the degradation vulnerable region DVR may be performed more finely compared with the sensing operation for the normal region NR, and the size of the scan driver 120 and the power consumption of the OLED display device 100 may be effectively reduced.

Figure 8:
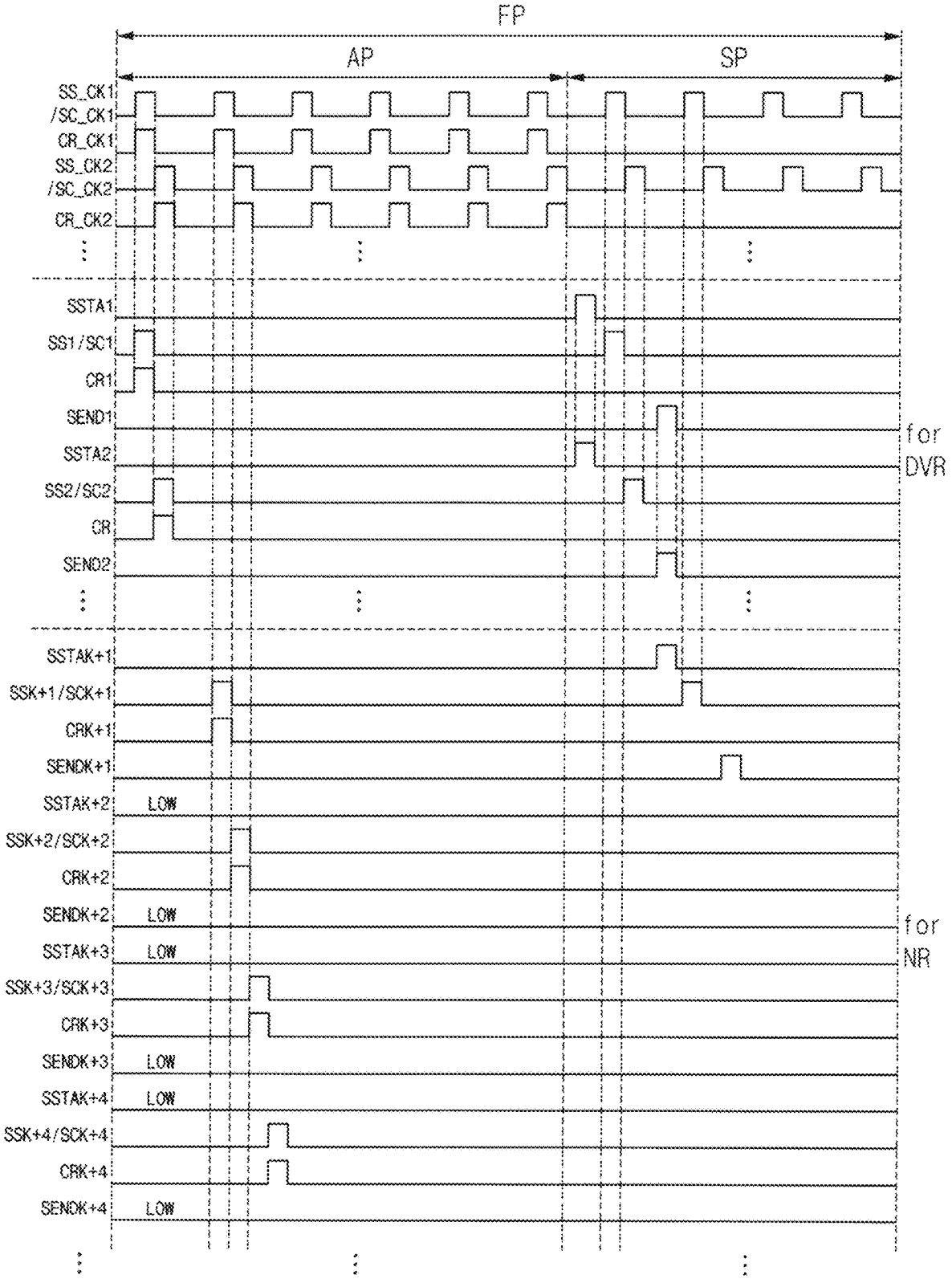
FIG. 8 is a timing diagram for describing an example of an operation of a scan driver of FIG. 7.
Figure 9:
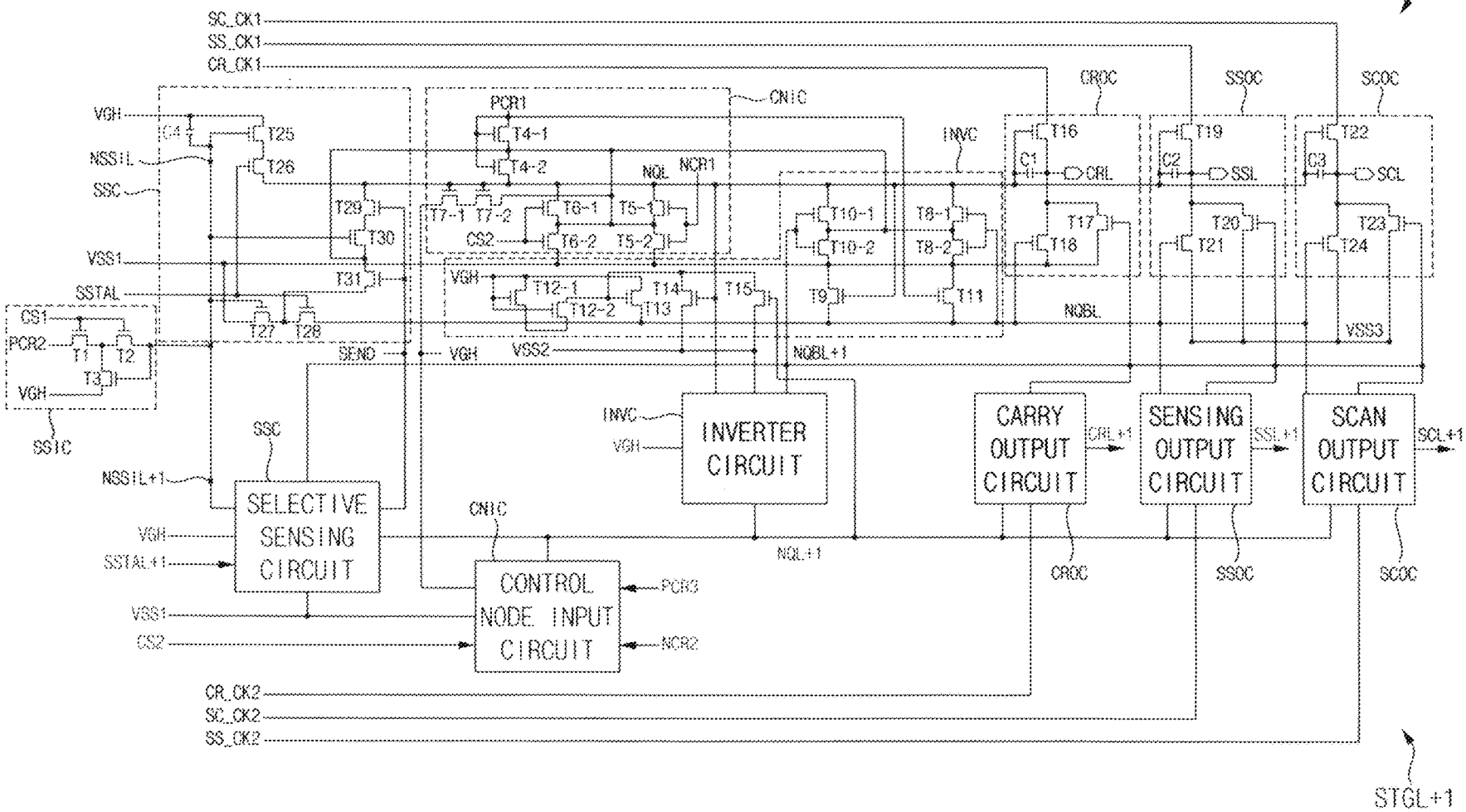
FIG. 9 is a circuit diagram illustrating an example of an L-th stage and an (L+1)-th stage included in a scan driver according to embodiments.
Figure 10:
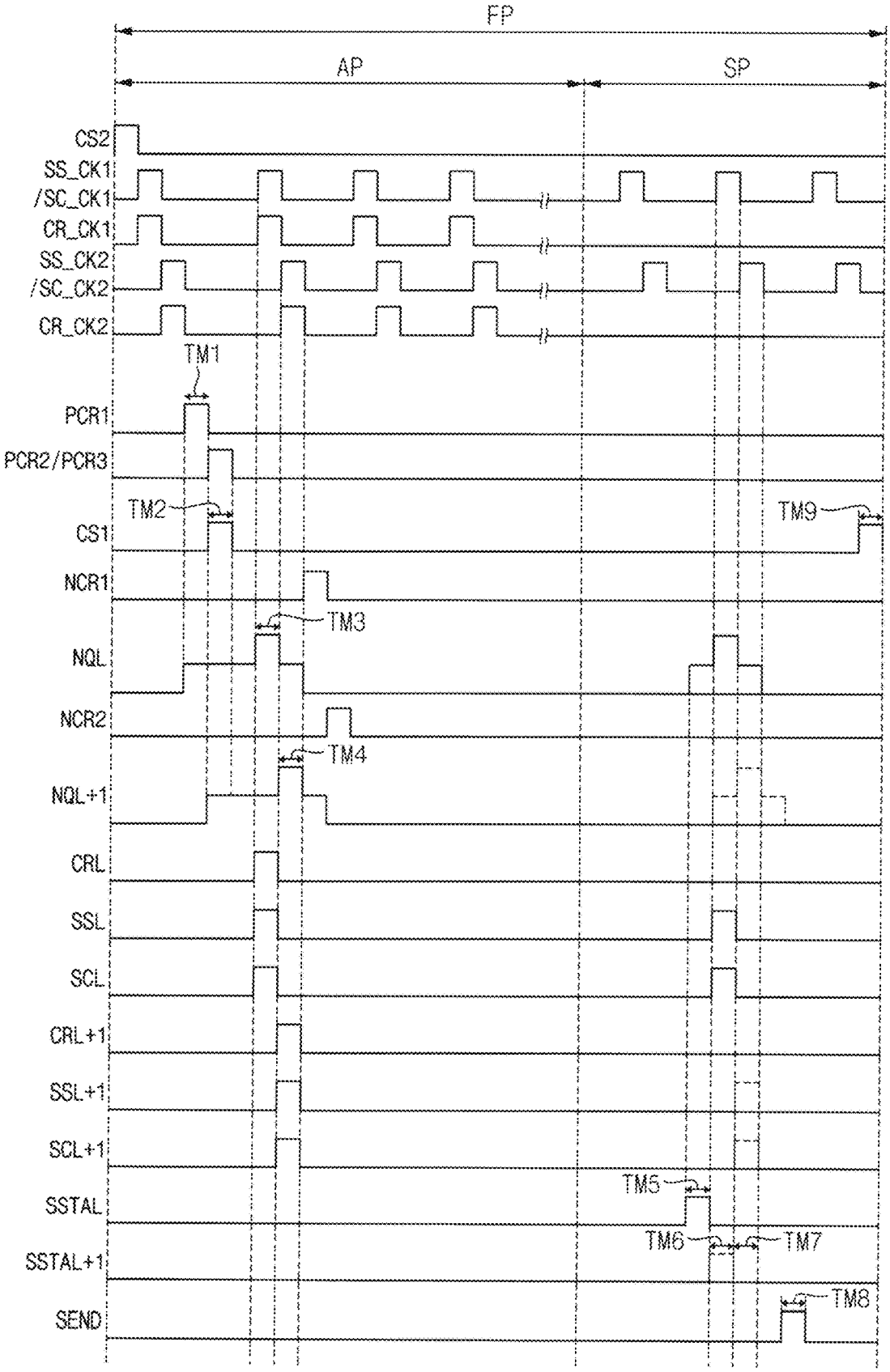
FIG. 10 is a timing diagram for describing an example of an operation of an L-th stage and an (L+1)-th stage illustrated in FIG. 9.

FIG. 7 is a block diagram illustrating a scan driver according to embodiments, FIG. 8 is a timing diagram for describing an example of an operation of a scan driver of FIG. 7, FIG. 9 is a circuit diagram illustrating an example of an L-th stage and an (L+1)-th stage included in a scan driver according to embodiments, and FIG. 10 is a timing diagram for describing an example of an operation of an L-th stage and an (L+1)-th stage illustrated in FIG. 9.

Referring to FIG. 7, a scan driver 200 according to embodiments may include a plurality of first stages STG1, STG2, . . . , and STGP−K+1, STGP−K+2, . . . providing sensing signals SS1, SS2, . . . , and SSP−K+1, SSP−K+2, . . . and scan signals SC1, SC2, . . . , and SCP−K+1, SCP−K+2, . . . to a degradation vulnerable region DVR of a display panel. The scan driver 200 according to embodiments may also include a plurality of second stages STGK+1, STGK+2, STGK+3, STGK+4, . . . providing the scan signals SCK+1, SCK+2, SCK+3, SCK+4, . . . and the sensing signals SSK+1, SSK+2, SSK+3, SSK+4, . . . to a normal region NR of the display panel.

Two stages of the plurality of first stages STG1, STG2, . . . , and STGP−K+1, STGP−K+2, . . . for the degradation vulnerable region DVR may share one selective sensing input circuit SSIC. For example, first and second stages STG1 and STG2 for the degradation vulnerable region DVR may share a selective sensing input circuit 210, and (P−K+1)-th and (P−K+2)-th stages STGP−K+1 and STGP−K+2 for the degradation vulnerable region DVR may share a selective sensing input circuit 250. Further, 2N (e.g., four) stages of the plurality of second stages STGK+1, STGK+2, STGK+3, STGK+4, . . . for the normal region NR may share one selective sensing input circuit SSIC. For example, (K+1)-th, (K+2)-th, (K+3)-th and (K+4)-th stages STGK+1, STGK+2, STGK+3 and STGK+4 for the normal region NR may share a selective sensing input circuit 230. Accordingly, a size of the scan driver 200 may be effectively reduced compared with a size of a scan driver where each stage includes one selective sensing input circuit SSIC.

The plurality of first and second stages STG1, STG2, . . . , STGK+1, STGK+2, STGK+3, STGK+4, . . . , STGP−K+1, STGP−K+2, . . . may receive one or more sensing clock signals SS_CK1, SS_CK2, SS_CK3 and SS_CK4, one or more scan clock signals SC_CK1, SC_CK2, SC_CK3 and SC_CK4, and one or more carry clock signals CR_CK1, CR_CK2, CR_CK3 and CR_CK4. The plurality of first and second stages STG1, STG2, . . . , STGK+1, STGK+2, STGK+3, STGK+4, . . . , STGP−K+1, STGP−K+2, . . . may further receive corresponding previous carry signals PCR_STG1, PCR_STG2, . . . , PCR_STGK+1, PCR_STGK+2, PCR_STGK+3, PCR_STGK+4, . . . , PCR_STGP−K+1, PCR_STGP−K+2, . . . (or a scan start signal). Each stage (e.g., STG1) may generate a carry signal (e.g., CR1) based on a previous carry signal (e.g., PCR_STG1) and a carry clock signal (e.g., CR_CK1), may generate a sensing signal (e.g., SS1) based on the previous carry signal (e.g., PCR_STG1) and a sensing clock signal (e.g., SS_CK1), and may generate a scan signal (e.g., SC1) based on the previous carry signal (e.g., PCR_STG1) and a scan clock signal (e.g., SC_CK1).

Further, the plurality of first and second stages STG1, STG2, . . . , STGK+1, STGK+2, STGK+3, STGK+4, . . . , STGP−K+1, STGP−K+2, . . . may receive corresponding sensing start signals SSTA1, SSTA2, . . . , SSTAK+1, SSTAK+2, SSTAK+3, SSTAK+4, . . . , SSTAP−K+1, SSTAP−K+2, . . . and corresponding sensing end signals SEND1, SEND2, . . . , SENDK+1, SENDK+2, SENDK+3, SENDK+4, . . . , SENDP−K+1, SENDP−K+2, . . . , respectively. In a sensing period, each stage (e.g., STG1) may generate the sensing signal (e.g., SS1) and the scan signal (e.g., SC1) based on the sensing clock signal (e.g., SS_CK1) and the scan clock signal (e.g., SC_CK1) during a period from a time point at which the sensing start signal (e.g., SSTA1) is applied to a time period at which the sensing end signal SEND1 is applied.

In an embodiment, for example, as illustrated in FIG. 8, the sensing clock signals SS_CK1, SS_CK2, . . . and the scan clock signals SC_CK1, SC_CK2, . . . may periodically toggle in an active period AP and a sensing period SP of each frame period FP. The carry clock signals CR_CK1, CR_CK2, . . . may periodically toggle in the active period AP of each frame period FP, and the carry clock signals CR_CK1, CR_CK2, . . . may have a substantially constant level, for example, a low level in the sensing period SP of each frame period FP.

In the active period AP, the plurality of first stages STG1, STG2, . . . , and STGP−K+1, STGP−K+2, . . . for the degradation vulnerable region DVR and the plurality of second stages STGK+1, STGK+2, STGK+3, STGK+4, . . . for the normal region NR may sequentially generate the sensing signals SS1, SS2, . . . , SSK+1, SSK+2, SSK+3, SSK+4, . . . , the scan signals SC1, SC2, . . . , SCK+1, SCK+2, SCK+3, SCK+4, . . . and the carry signals CR1, CR2, . . . , CRK+1, CRK+2, CRK+3, CRK+4, . . . based on the sensing clock signals SS_CK1, SS_CK2, . . . , the scan clock signals SC_CK1, SC_CK2, . . . and the carry clock signals CR_CK1, CR_CK2, . . . , respectively. The plurality of first stages STG1, STG2, . . . , and STGP−K+1, STGP−K+2, . . . and the plurality of second stages STGK+1, STGK+2, STGK+3, STGK+4, . . . may sequentially provide the sensing signals SS1, SS2, SSK+1, SSK+2, SSK+3, SSK+4, . . . and the scan signals SC1, SC2, . . . , SCK+1, SCK+2, SCK+3, SCK+4, . . . to all of pixel rows of the degradation vulnerable region DVR and all of pixel rows of the normal region NR in the active period AP.

In the sensing period SP, the plurality of first stages STG1, STG2, . . . , and STGP−K+1, STGP−K+2, . . . for the degradation vulnerable region DVR may provide the sensing signals SS1, SS2, . . . and the scan signals SC1, SC2, . . . to all of the pixel rows of the degradation vulnerable region DVR. The plurality of second stages STGK+1, STGK+2, STGK+3, STGK+4, . . . for the normal region NR may provide the sensing signals SSK+1, and the scan signals SCK+1, . . . to a portion of the pixel rows of the normal region NR in the sensing period SP.

In an embodiment, for example, a first stage STG1 of the plurality of first stages STG1, STG2, . . . , and STGP−K+1, STGP−K+2, . . . for the degradation vulnerable region DVR may generate a first sensing signal SS1 and a first scan signal SC1 based on a first sensing clock signal SS_CK1 and a first scan clock signal SC_CK1 in a period from a time point at which a first sensing start signal SSTA1 is applied to a time point at which a first sensing end signal SEND1 is applied. A second stage STG2 of the plurality of first stages STG1, STG2, . . . , and STGP−K+1, STGP−K+2, . . . for the degradation vulnerable region DVR may also generate a second sensing signal SS2 and a second scan signal SC2 based on a second sensing clock signal SS_CK2 and a second scan clock signal SC_CK2 in a period from a time point at which a second sensing start signal SSTA2 is applied to a time point at which a second sensing end signal SEND2 is applied. Although FIG. 8 illustrates an example where the first and second sensing start signals SSTA1 and SSTA2 have substantially the same timing and the first and second sensing end signals SEND1 and SEND2 have substantially the same timing, timings of the sensing start and end signals SSTA1, SSTA2, SEND1 and SEND2 according to the invention may not be limited to the example of FIG. 8.

In contrast, in an embodiment, for example, with respect to the plurality of second stages STGK+1, STGK+2, STGK+3, STGK+4, . . . for the normal region NR, only one sensing start signal SSTAK+1 and only one sensing end signal SENDK+1 among sensing start signals SSTAK+1, SSTAK+2, SSTAK+3 and SSTAK+4 and sensing end signals SENDK+1, SENDK+2, SENDK+3 and SENDK+4 for 2N (e.g., four) stages STGK+1, STGK+2, STGK+3 and STGK+4 may have pulses in the sensing period SP, and the remaining sensing start signals SSTAK+2, SSTAK+3 and SSTAK+4 and the remaining sensing end signals SENDK+2, SENDK+3 and SENDK+4 may be maintained as a low level LOW at the same time. Accordingly, among the four stages STGK+1, STGK+2, STGK+3 and STGK+4, one stage STGK+1 may generate a corresponding sensing signal SSK+1 and a corresponding scan signal SCK+1 based on a corresponding sensing clock signal SS_CK1 and a corresponding scan clock signal SC_CK1 in a period from a time point at which a corresponding sensing start signal SSTAK+1 is applied to a time point at which a corresponding sensing end signal SENDK+1 is applied, but the remaining stages STGK+2, STGK+3 and STGK+4 may not generate corresponding sensing signals SSK+2, SSK+3 and SSK+4 and corresponding scan signals SCK+2, SCK+3 and SCK+4. Accordingly, in the sensing period SP, a sensing operation may be performed on one pixel row per the four pixel rows of the normal region NR, and thus the entire sensing time and power consumption may be effectively reduced. In some embodiments, one stage STGK+1 generating the corresponding sensing signal SSK+1 and the corresponding scan signal SCK+1 in the sensing period SP among the four stages STGK+1, STGK+2, STGK+3 and STGK+4 may be changed per each frame period FP.

To perform these operations, in some embodiments, as illustrated in FIG. 9, each stage of the plurality of first stages STG1, STG2, . . . , and STGP−K+1, STGP−K+2, . . . and the plurality of second stages STGK+1, STGK+2, STGK+3, STGK+4, . . . may include a control node input circuit CNIC, an inverter circuit INVC, a carry output circuit CROC, a sensing output circuit SSOC, a scan output circuit SCOC and a selective sensing circuit SSC. At least two stages STGL and STGL+1 may share or include one selective sensing input circuit SSIC. The stages STGL and STGL+1 of FIG. 9 may be consecutive two stages of the plurality of first stages STG1, STG2, . . . , and STGP−K+1, STGP−K+2, . . . for the degradation vulnerable region DVR, or may be consecutive two stages of the plurality of second stages STGK+1, STGK+2, STGK+3, STGK+4, . . . for the normal region NR.

The control node input circuit CNIC may transfer a previous carry signal (e.g., a first previous carry signal PCR1 or a third previous carry signal PCR3) to a control node NQL (or NQL+1) in response to the previous carry signal (e.g., the first previous carry signal PCR1 or the third previous carry signal PCR3), and may transfer a low voltage VSS1 (e.g., a first low voltage) to the control node NQL (or NQL+1) in response to a next carry signal NCR1 (or NCR2). For example, the first previous carry signal PCR1 for an L-th stage STGL according to the invention may be, but not be limited to, a carry signal of an (L−3)-th stage, the next carry signal NCR1 for an L-th stage STGL may be, but not be limited to, a carry signal of an (L+4)-th stage, the previous carry signal (the third previous carry signal PCR3) for an (L+1)-th stage STGL+1 may be, but not be limited to, a carry signal of an (L−2)-th stage, and the next carry signal NCR2 for the (L+1)-th stage STGL+1 according to the invention may be, but not be limited to, a carry signal of an (L+5)-th stage.

In some embodiments, as illustrated in FIG. 9, the control node input circuit CNIC may include a fourth transistor T4-1 and T4-2 that transfers the first previous carry signal PCR1 to the control node NQL in response to the first previous carry signal PCR1, a fifth transistor T5-1 and T5-2 that transfers the low voltage VSS1 to the control node NQL in response to the next carry signal NCR1, and a sixth transistor T6-1 and T6-2 that transfers the low voltage VSS1 to the control node NQL in response to a second control signal CS2. In some embodiments, each of the fourth transistor T4-1 and T4-2, the fifth transistor T5-1 and T5-2 and the sixth transistor T6-1 and T6-2 may be implemented with a dual transistor including two sub-transistors, and the control node input circuit CNIC may further include a seventh transistor T7-1 and T7-2 that transfers a high voltage VGH (e.g., a high gate voltage) to nodes between the sub-transistors in response to a voltage of the control node NQL. In some embodiments, the seventh transistor T7-1 and T7-2 also may be implemented with a dual transistor including two sub-transistors.

The inverter circuit INVC may perform an inverting operation such that the control node NQL (or NQL+1) and an inverted control node NQBL (or NQBL+1) have opposite voltages from each other. Thus, the inverter circuit INVC of the L-th stage STGL may allow the inverted control node NQBL to have a low voltage when the control node NQL has a high voltage, and may allow the control node NQL to have a low voltage when the inverted control node NQBL has a high voltage. Further, the inverter circuit INVC of the (L+1)-th stage STGL+1 may allow the inverted control node NQBL+1 to have a low voltage when the control node NQL+1 has a high voltage, and may allow the control node NQL+1 to have a low voltage when the inverted control node NQBL+1 has a high voltage.

In some embodiments, as illustrated in FIG. 9, the inverter circuit INVC may include an eighth transistor T8-1 and T8-2 that transfers the low voltage VSS1 to the control node NQL in response to a voltage of the inverted control node NQBL, and a ninth transistor T9 that transfers the low voltage VSS1 to the inverted control node NQBL in response to the voltage of the control node NQL. In some embodiments, the inverter circuit INVC of the L-th stage STGL may further include a tenth transistor T10-1 and T10-2 that transfers the low voltage VSS1 to the control node NQL in response to a voltage of the inverted control node NQBL+1 of the (L+1)-th stage STGL+1, and an eleventh transistor T11 that transfers the low voltage VSS1 to the inverted control node NQBL in response to the first previous carry signal PCR1. In some embodiments, each of the eighth transistor T8-1 and T8-2 and the tenth transistor T10-1 and T10-2 may be implemented with a dual transistor including two sub-transistors. In some embodiments, the inverter circuit INVC of the L-th stage STGL may further include a twelfth transistor T12-1 and T12-2 that is turned on in response to the high voltage VGH, a thirteenth transistor T13, a fourteenth transistor T14 that is turned on in response to the voltage of the control node NQL, and a fifteenth transistor T15 that is turned on in response to a voltage of the control node NQL+1 of the (L+1)-th stage STGL+1. The thirteenth transistor T13 may be turned off based on a low voltage VSS2 (e.g., a second low voltage) that is applied to a gate of the thirteenth transistor T13 while the fifteenth transistor T15 is turned on, and may transfer the high voltage VGH to the inverted control node NQBL while both of the fourteenth transistor T14 and the fifteenth transistor T15 are turned off.

The carry output circuit CROC may output a carry signal CRL (or CRL+1) based on the voltage of the control node NQL (or NQL+1) and a carry clock signal CR_CK1 (or CR_CK2). Thus, the carry output circuit CROC of the L-th stage STGL may output the carry signal CRL while the control node NQL has a high voltage and the carry clock signal CR_CK1 has a high voltage. The carry output circuit CROC of the (L+1)-th stage STGL+1 may output the carry signal CRL+1 while the control node NQL+1 has a high voltage and the carry clock signal CR_CK2 has a high voltage.

In some embodiments, as illustrated in FIG. 9, the carry output circuit CROC may include a sixteenth transistor T16 that outputs the carry clock signal CR_CK1 as the carry signal CRL based on the voltage of the control node NQL and the carry clock signal CR_CK1, and a first capacitor C1 for a bootstrap operation. The carry output circuit CROC may also include a seventeenth transistor T17 that outputs the low voltage VSS1 as the carry signal CRL in response to the voltage of the inverted control node NQBL+1 of the (L+1)-th stage STGL+1, and an eighteenth transistor T18 that outputs the low voltage VSS1 as the carry signal CRL in response to the inverted control node NQBL.

The sensing output circuit SSOC may output a sensing signal SSL (or SSL+1) based on the voltage of the control node NQL (or NQL+1) and a sensing clock signal SS_CK1 (or SS_CK2). Thus, the sensing output circuit SSOC of the L-th stage STGL may output the sensing signal SSL while the control node NQL has a high voltage and the sensing clock signal SS_CK1 has a high voltage, and the sensing output circuit SSOC of the (L+1)-th stage STGL+1 may output the sensing signal SSL+1 while the control node NQL+1 has a high voltage and the sensing clock signal SS_CK2 has a high voltage.

In some embodiments, as illustrated in FIG. 9, the sensing output circuit SSOC may include a nineteenth transistor T19 that outputs the sensing clock signal SS_CK1 as the sensing signal SSL based on the voltage of the control node NQL and the sensing clock signal SS_CK1, and a second capacitor C2 for a bootstrap operation. The sensing output circuit SSOC may also include a twentieth transistor T20 that outputs a low voltage VSS3 (e.g., a third low voltage) as the sensing signal SSL in response to the inverted control node NQBL+1 of the (L+1)-th stage STGL+1, and a twenty-first transistor T21 that outputs the low voltage VSS3 as the sensing signal SSL in response to the voltage of the inverted control node NQBL.

The scan output circuit SCOC may output a scan signal SCL (or SCL+1) based on the voltage of the control node NQL (or NQL+1) and a scan clock signal SC_CK1 (or SC_CK2). Thus, the scan output circuit SCOC of the L-th stage STGL may output the scan signal SCL while the control node NQL has a high voltage and the scan clock signal SC_CK1 has a high voltage, and the scan output circuit SCOC of the (L+1)-th stage STGL+1 may output the scan signal SCL+1 while the control node NQL+1 has a high voltage and the scan clock signal SC_CK2 has a high voltage.

In some embodiments, as illustrated in FIG. 9, the scan output circuit SCOC may include a twenty-second transistor T22 that outputs the scan clock signal SC_CK1 as the scan signal SCL based on the voltage of the control node NQL and the scan clock signal SC_CK1, and a third capacitor C3 for a bootstrap operation. The scan output circuit SCOC may also include a twenty-third transistor T23 that outputs the low voltage VSS3 as the scan signal SCL in response to the voltage of the inverted control node NQBL+1 of the (L+1)-th stage STGL+1, and a twenty-fourth transistor T24 that outputs the low voltage VSS3 as the scan signal SCL in response to the voltage of the inverted control node NQBL.

The selective sensing circuit SSC may transfer the high voltage VGH to the control node NQL (or NQL+1) based on a voltage of a selective sensing input node NSSIL (or NSSIL+1) and a sensing start signal SSTAL (or SSTAL+1). Further, the selective sensing circuit SSC may transfer the low voltage VSS1 to the control node NQL (or NQL+1) based on the voltage of the selective sensing input node NSSIL (or NSSIL+1) and a sensing end signal SEND. As illustrated in FIG. 9, the selective sensing input node NSSIL of the L-th stage STGL and the selective sensing input node NSSIL+1 of the (L+1)-th stage STGL+1 may be coupled to each other. In some embodiments, the same sensing end signal SEND may be applied to the selective sensing circuit SSC of the L-th stage STGL and the selective sensing circuit SSC of the (L+1)-th stage STGL+1.

In some embodiments, as illustrated in FIG. 9, the selective sensing circuit SSC may include a twenty-fifth transistor T25 that is turned on in repose to the voltage of the selective sensing input node NSSIL, a fourth capacitor C4 coupled between a line of the high voltage VGH and the selective sensing input node NSSIL, and a twenty-sixth transistor T26 that is turned on in response to the sensing start signal SSTAL. The twenty-fifth and twenty-sixth transistors T25 and T26 may transfer the high voltage VGH to the control node NQL while the selective sensing input node NSSIL has a high voltage and the sensing start signal SSTAL has a high voltage. The selective sensing circuit SSC may further include a twenty-seventh transistor T27 that is turned on in response to the voltage of the selective sensing input node NSSIL, and a twenty-eighth transistor T28 that is turned on in response to the sensing start signal SSTAL. The twenty-seventh and twenty-eighth transistors T27 and T28 may transfer the low voltage VSS1 to the inverted control node NQBL while the selective sensing input node NSSIL has a high voltage and the sensing start signal SSTAL has a high voltage. In some embodiments, the selective sensing circuit SSC may further include twenty-ninth and thirty-first transistors T29 and T31 that are turned on in response to the sensing end signal SEND, and a thirtieth transistor T30 that is turned on in response to the voltage of the selective sensing input node NSSIL. The twenty-seventh, twenty-ninth, thirtieth and thirty-first transistors T27, T29, T30 and T31 may transfer the low voltage VSS1 to the control node NQL while the selective sensing input node NSSIL has a high voltage and the sensing end signal SEND has a high voltage.

The selective sensing input circuit SSIC may provide a second previous carry signal PCR2 to the selective sensing input nodes NSSIL and NSSIL+1 of the L-th and (L+1)-th stages STGL and STGL+1 in response to a first control signal CS1. In some embodiments, the second previous carry signal PCR2 according to the invention may be, but not be limited to, a carry signal of an (L−2)-th stage. In the scan driver 200 according to embodiments, two stages (e.g., STG1 and STG2, or STGP−K+1 and STGP−K+2) of the plurality of first stages STG1, STG2, . . . , and STGP−K+1, STGP−K+2, . . . for the degradation vulnerable region DVR may share or include one selective sensing input circuit SSIC that provides the previous carry signal PCR2 to the selective sensing input nodes (e.g., NSSI1 and NSSI2, or NSSIP−K+1 and NSSIP−K+2) of the two stages. In the scan driver 200, 2N (e.g., four) stages (e.g., STGK+1, STGK+2, STGK+3 and STGK+4) of the plurality of second stages STGK+1, STGK+2, STGK+3, STGK+4, . . . for the normal region NR may share or include one selective sensing input circuit SSIC that provides the previous carry signal to the selective sensing input nodes (e.g., NSSIK+1, NSSIK+2, NSSIK+3 and NSSIK+4) of the 2N stages.

In some embodiments, as illustrated in FIG. 9, the selective sensing input circuit SSIC may include first and second transistors T1 and T2 that are turned on in response to the first control signal CS1, and a third transistor T3 that applies the high voltage VGH to a node between the first and second transistors T1 and T2 in response to the voltage of the selective sensing input node NSSIL.

Hereinafter, an operation of the L-th and (L+1)-th stages STGL and STGL+1 will be described below with reference to FIGS. 9 and 10.

The sensing clock signals SS_CK1 and SS_CK2 and the scan clock signals SC_CK1 and SC_CK2 may periodically toggle in an active period AP and a sensing period SP of each frame period FP. The carry clock signals CR_CK1 and CR_CK2 may periodically toggle in the active period AP of each frame period FP, and may have a substantially constant level, for example, a low level in the sensing period SP of each frame period FP In some embodiments, the second control signal CS2 may be applied to the L-th and (L+1)-th stages STGL and STGL+1 at a start time point or an end time point of the frame period FP. The control node input circuit CNIC of the L-th stage STGL may apply the low voltage VSS1 to the control node NQL in response to the second control signal CS2, and the control node input circuit CNIC of the (L+1)-th stage STGL+1 may apply the low voltage VSS1 to the control node NQL+1 in response to the second control signal CS2.

During a first time TM1 of the active period AP, the first previous carry signal PCR1 (e.g., a carry signal of an (L−3)-th stage) may be applied. The control node input circuit CNIC of the L-th stage STGL may transfer the first previous carry signal PCR1 to the control node NQL, and the control node NQL may have a high voltage.

During a second time TM2 of the active period AP, a second/third previous carry signals PCR2/PCR3 (e.g., a carry signal of an (L−2)-th stage) may be applied. The control node input circuit CNIC of the (L+1)-th stage STGL+1 may transfer a third previous carry signal PCR3 to the control node NQL+1, and the control node NQL+1 may have a high voltage. Further, during the second time TM2, the first control signal CS1 may be applied, the selective sensing input circuit SSIC may transfer the second previous carry signal PCR2 to the selective sensing input nodes NSSIL and NSSIL+1 in response to the first control signal CS1, and the selective sensing input nodes NSSIL and NSSIL+1 may have a high voltage.

During a third time TM3 of the active period AP, the first sensing clock signal SS_CK1, the first scan clock signal SC_CK1 and the first carry clock signal CR_CK1 may be applied. The voltage of the control node NQL in the L-th stage STGL may be bootstrapped by the first capacitor C1, the second capacitor C2 and/or the third capacitor C3. The carry output circuit CROC of the L-th stage STGL may output carry signal CRL based on the bootstrapped voltage, the sensing output circuit SSOC of the L-th stage STGL may output the sensing signal SSL based on the bootstrapped voltage, and the scan output circuit SCOC of the L-th stage STGL may output the scan signal SCL based on the bootstrapped voltage.

During a fourth time TM4 of the active period AP, the second sensing clock signal SS_CK2, the second scan clock signal SC_CK2 and the second carry clock signal CR_CK2 may be applied. The voltage of the control node NQL+1 in the (L+1)-th stage STGL+1 may be bootstrapped. The carry output circuit CROC of the (L+1)-th stage STGL+1 may output the carry signal CRL+1 based on the bootstrapped voltage, the sensing output circuit SSOC of the (L+1)-th stage STGL+1 may output the sensing signal SSL+1 based on the bootstrapped voltage, and the scan output circuit SCOC of the (L+1)-th stage STGL+1 may output the scan signal SCL+1 based on the bootstrapped voltage.

During a fifth time TM5 of the sensing period SP, the sensing start signal SSTAL may be applied to the L-th stage STGL. The selective sensing circuit SSC of the L-th stage STGL may transfer the high voltage VGH to the control node NQL in response to the high voltage of the selective sensing input node NSSIL and the sensing start signal SSTAL.

During a sixth time TM6 of the sensing period SP, the first sensing clock signal SS_CK1 and the first scan clock signal SC_CK1 may be applied. The voltage of the control node NQL in the L-th stage STGL may be bootstrapped by the second capacitor C2 and/or the third capacitor C3. The sensing output circuit SSOC of the L-th stage STGL may output the sensing signal SSL based on the bootstrapped voltage, and the scan output circuit SCOC of the L-th stage STGL may output the scan signal SCL based on the bootstrapped voltage.

In some embodiments, in a case where the L-th and (L+1)-th stages STGL and STGL+1 are stages for the normal region NR, the sensing start signal SSTAL+1 may not be applied to the (L+1)-th stage STGL+1, and the (L+1)-th stage STGL+1 may not output the sensing signal SSL+1 and the scan signal SCL+1 in the sensing period SP.

In other embodiments, in a case where the L-th and (L+1)-th stages STGL and STGL+1 are stages for the degradation vulnerable region DVR, the sensing start signal SSTAL+1 may be applied to the (L+1)-th stage STGL+1 during the sixth time TM6. The selective sensing circuit SSC of the (L+1)-th stage STGL+1 may transfer the high voltage VGH to the control node NQL+1 in response to the high voltage of the selective sensing input node NSSIL+1 and the sensing start signal SSTAL+1. Thereafter, during a seventh time TM7, the second sensing clock signal SS_CK2 and the second scan clock signal SC_CK2 may be applied, and the voltage of the control node NQL+1 in the (L+1)-th stage STGL+1 may be bootstrapped. The sensing output circuit SSOC of the (L+1)-th stage STGL+1 may output the sensing signal SSL+1 based on the bootstrapped voltage, and the scan output circuit SCOC of the (L+1)-th stage STGL+1 may output the scan signal SCL+1 based on the bootstrapped voltage.

During an eighth time TM8 of the sensing period SP, the sensing end signal SEND may be applied. The selective sensing circuits SSC of the L-th and (L+1)-th stages STGL and STGL+1 may transfer the low voltage VSS1 to the control nodes NQL and NQL+1 in response to the high voltages of the selective sensing input nodes NSSIL and NSSIL+1 and the sensing end signal SEND.

During a ninth time TM9 of the sensing period SP, the first control signal CS1 may be again applied, for example, at an end time point of the sensing period SE The selective sensing input circuit SSIC may transfer the second previous carry signal PCR2 having a low voltage to the selective sensing input nodes NSSIL and NSSIL+1 in response to the first control signal CS1, and the selective sensing input nodes NSSIL and NSSIL+1 may be initialized to the low voltage.

In this manner, the L-th and (L+1)-th stages STGL and STGL+1 may sequentially output the carry signals CRL and CRL+1), the sensing signals SSL and SSL+1 and the scan signals SCL and SCL+1 in the active period AP. In a case where the L-th and (L+1)-th stages STGL and STGL+1 are stages for the normal region NR, in the sensing period SP, only one stage STGL of the L-th and (L+1)-th stages STGL and STGL+1 may output the sensing signal SSL and the scan signal SCL. Further, in a case where the L-th and (L+1)-th stages STGL and STGL+1 are stages for the degradation vulnerable region DVR, in the sensing period SP, the L-th and (L+1)-th stages STGL and STGL+1 may sequentially output the sensing signals SSL and SSL+1 and the scan signals SCL and SCL+1.

As described above, in the scan driver 200 according to embodiments, two stages (e.g., STG1 and STG2) of the plurality of first stages STG1, STG2, . . . , and STGP−K+1, STGP−K+2, . . . for the degradation vulnerable region DVR may share one selective sensing input circuit SSIC. 2N stages (e.g., STGK+1, STGK+2, STGK+3 and STGK+4) of the plurality of second stages STGK+1, STGK+2, STGK+3, STGK+4, . . . for the normal region NR may share one the selective sensing input circuit SSIC in the scan driver 200 according to embodiments. Accordingly, a sensing operation for the degradation vulnerable region DVR may be performed more finely (or minutely) compared with a sensing operation for the normal region NR, and a size and power consumption of the scan driver 200 may be effectively reduced.

FIG. 11 is a block diagram illustrating a scan driver according to another embodiment.

Referring to FIG. 11, a scan driver 300 according to embodiments may include a plurality of first stages STG1, STG2, . . . , and STGP−K+1, STGP−K+2, . . . for a degradation vulnerable region DVR of a display panel, a plurality of second stages STGK+1, STGK+2, STGK+3, STGK+4, . . . for a normal region NR of the display panel, and at least one extension switch TEXT. The scan driver 300 of FIG. 11 may have a similar configuration and a similar operation to a scan driver 200 of FIG. 7, except for that the scan driver 300 may further include the extension switch TEXT.

Two stages (e.g., STG1 and STG2, or STGP−K+1 and STGP−K+2) of the plurality of first stages STG1, STG2, . . . , and STGP−K+1, STGP−K+2, . . . for the degradation vulnerable region DVR may share one selective sensing input circuit 310 or 350 coupled to selective sensing input nodes (e.g., NSSI1 and NSSI2, or NSSIP−K+1 and NSSIP−K+2) of the two stages.

2N stages (e.g., STGK+1, STGK+2, STGK+3 and STGK+4) of the plurality of second stages STGK+1, STGK+2, STGK+3, STGK+4, . . . for the normal region NR may share one selective sensing input circuit 330 coupled to selective sensing input nodes (e.g., NSSIK+1, NSSIK+2, NSSIK+3 and NSSIK+4) of the 2N stages through the extension switch TEXT. Accordingly, a size and power consumption of the scan driver 300 may be effectively reduced. In some embodiments, the extension switch TEXT may selectively couple the selective sensing input nodes (e.g., NSSIK+1, NSSIK+2, NSSIK+3 and NSSIK+4) of the 2N stages to each other in response to an extension signal SEXT.

Figure 12:
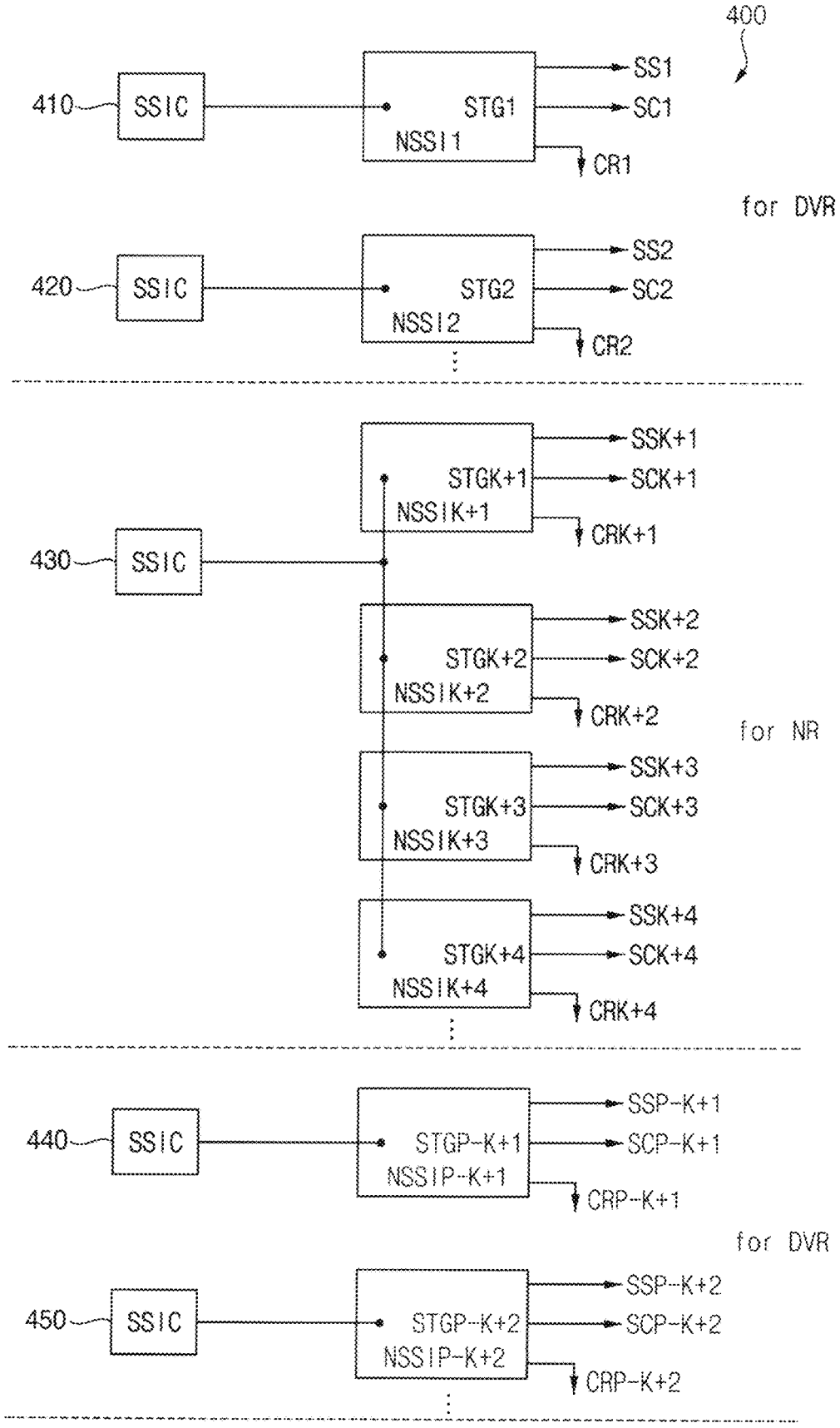
FIG. 12 is a block diagram illustrating a scan driver according to still another embodiment.

FIG. 12 is a block diagram illustrating a scan driver according to still another embodiment.

Referring to FIG. 12, a scan driver 400 according to embodiments may include a plurality of first stages STG1, STG2, . . . , and STGP−K+1, STGP−K+2, . . . for a degradation vulnerable region DVR of a display panel, and a plurality of second stages STGK+1, STGK+2, STGK+3, STGK+4, . . . for a normal region NR of the display panel. The scan driver 400 of FIG. 12 may have a similar configuration and a similar operation to a scan driver 200 of FIG. 7, except for that each of the plurality of first stages STG1, STG2, . . . , and STGP−K+1, STGP−K+2, . . . may include one selective sensing input circuit 410, 420, 440 or 450.

Each of the plurality of first stages STG1, STG2, . . . , and STGP−K+1, STGP−K+2, . . . for the degradation vulnerable region DVR may include one selective sensing input circuit 410, 420, 440 or 450. N stages (e.g., STGK+1, STGK+2, STGK+3 and STGK+4) of the plurality of second stages STGK+1, STGK+2, STGK+3, STGK+4, . . . for the normal region NR may share or include one selective sensing input circuit 430. Accordingly, a size and power consumption of the scan driver 400 may be effectively reduced.

Figure 13:
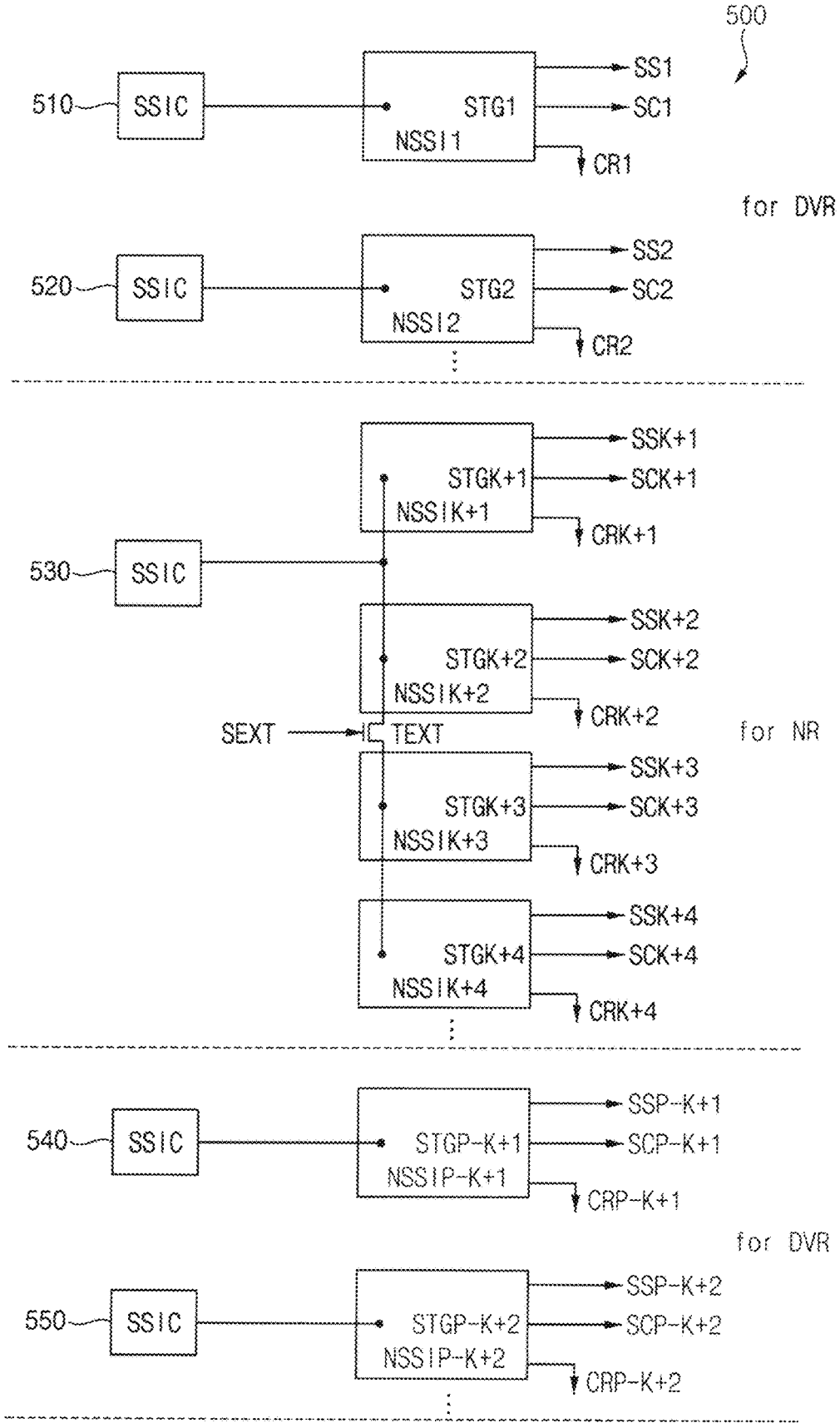
FIG. 13 is a block diagram illustrating a scan driver according to yet another embodiment.

FIG. 13 is a block diagram illustrating a scan driver according to yet another embodiment.

Referring to FIG. 13, a scan driver 500 according to embodiments may include a plurality of first stages STG1, STG2, . . . , and STGP−K+1, STGP−K+2, . . . for a degradation vulnerable region DVR of a display panel, a plurality of second stages STGK+1, STGK+2, STGK+3, STGK+4, . . . for a normal region NR of the display panel, and at least one extension switch TEXT. The scan driver 500 of FIG. 13 may have a similar configuration and a similar operation to a scan driver 400 of FIG. 12, except for that the scan driver 500 may further include the extension switch TEXT.

Each of the plurality of first stages STG1, STG2, . . . , and STGP−K+1, STGP−K+2, . . . for the degradation vulnerable region DVR may include one selective sensing input circuit 510, 520, 540 or 550. N stages (e.g., STGK+1, STGK+2, STGK+3 and STGK+4) of the plurality of second stages STGK+1, STGK+2, STGK+3, STGK+4, . . . for the normal region NR may share one selective sensing input circuit 530 coupled to selective sensing input nodes (e.g., NSSIK+1, NSSIK+2, NSSIK+3 and NSSIK+4) of the N stages through the extension switch TEXT. Accordingly, a size and power consumption of the scan driver 500 may be effectively reduced. In some embodiments, the extension switch TEXT may selectively couple the selective sensing input nodes (e.g., NSSIK+1, NSSIK+2, NSSIK+3 and NSSIK+4) of the N stages to each other in response to an extension signal SEXT.

Figure 14:
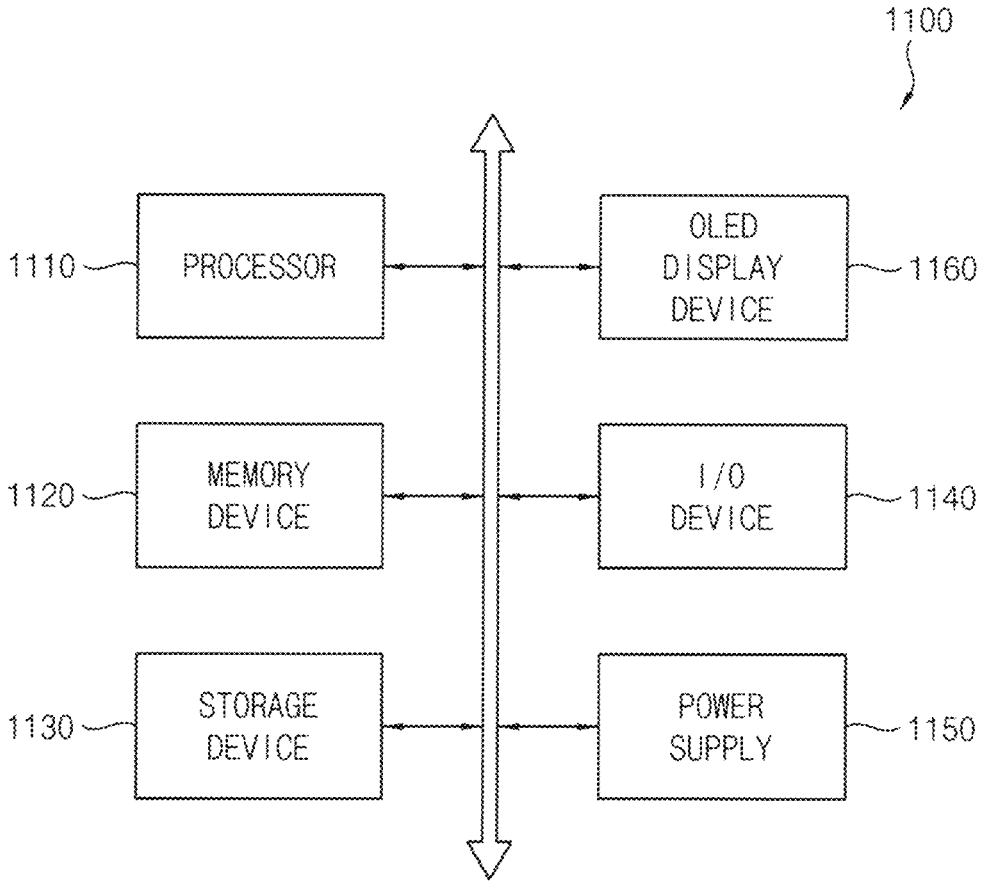
FIG. 14 is a block diagram illustrating an electronic device including an OLED display device according to embodiments.

FIG. 14 is a block diagram illustrating an electronic device including an OLED display device according to embodiments.

Referring to FIG. 14, an electronic device 1100 may include a processor 1110, a memory device 1120, a storage device 1130, an input/output ("I/O") device 1140, a power supply 1150, and an OLED display device 1160. The electronic device 1100 may further include a plurality of ports for communicating with a video card, a sound card, a memory card, a universal serial bus ("USB") device, other electric devices, etc.

The processor 1110 may perform various computing functions or tasks. The processor 1110 may be an application processor ("AP"), a microprocessor, a central processing unit ("CPU"), etc. The processor 1110 may be coupled to other components via an address bus, a control bus, a data bus, etc. Further, in some embodiments, the processor 1110 may be further coupled to an extended bus such as a peripheral component interconnection ("PCI") bus.

The memory device 1120 may store data for operations of the electronic device 1100. For example, the memory device 1120 may include at least one non-volatile memory device such as an erasable programmable read-only memory ("EPROM") device, an electrically erasable programmable read-only memory ("EEPROM") device, a flash memory device, a phase change random access memory ("PRAM") device, a resistance random access memory ("RRAM") device, a nano floating gate memory ("NFGM") device, a polymer random access memory ("PoRAM") device, a magnetic random access memory ("MRAM") device, a ferroelectric random access memory ("FRAM") device, etc., and/or at least one volatile memory device such as a dynamic random access memory ("DRAM") device, a static random access memory ("SRAM") device, a mobile dynamic random access memory (mobile "DRAM") device, etc.

The storage device 1130 may be a solid state drive ("SSD") device, a hard disk drive ("HDD") device, a CD-ROM device, etc. The I/O device 1140 may be an input device such as a keyboard, a keypad, a mouse, a touch screen, etc., and an output device such as a printer, a speaker, etc. The power supply 1150 may supply power for operations of the electronic device 1100. The OLED display device 1160 may be coupled to other components through the buses or other communication links.

In the OLED display device 1160, a configuration of a plurality of first stages providing scan signals and sensing signals to a first region (e.g., a degradation vulnerable region) of a display panel may be different from a configuration of a plurality of second stages providing the scan signals and the sensing signals to a second region (e.g., a normal region) of the display panel. Accordingly, a sensing operation for the first region (e.g., the degradation vulnerable region) may be performed more finely (or minutely) compared with a sensing operation for the second region (e.g., the normal region), and a size of a scan driver and power consumption of the OLED display device 1160 may be effectively reduced.

The inventive concepts may be applied any electronic device 1100 including the OLED display device 1160. For example, the inventive concepts may be applied to a television ("TV"), a digital TV, a 3D TV, a smart phone, a wearable electronic device, a tablet computer, a mobile phone, a personal computer ("PC"), a home appliance, a laptop computer, a personal digital assistant ("PDA"), a portable multimedia player ("PMP"), a digital camera, a music player, a portable game console, a navigation device, etc.

The foregoing is illustrative of embodiments and is not to be construed as limiting thereof. Although a few embodiments have been described, those skilled in the art will readily appreciate that many modifications are possible in the embodiments without materially departing from the novel teachings and advantages of the present inventive concept. Accordingly, all such modifications are intended to be included within the scope of the present inventive concept as defined in the claims. Therefore, it is to be understood that the foregoing is illustrative of various embodiments and is not to be construed as limited to the specific embodiments disclosed, and that modifications to the disclosed embodiments, as well as other embodiments, are intended to be included within the scope of the appended claims.

What is claimed is:

1. An organic light emitting diode (OLED) display device comprising:

a display panel including a first region and a second region; and a scan driver including a plurality of first stages and a plurality of second stages which are coupled to each other, wherein the plurality of first stages is configured to provide scan signals and sensing signals to the first region, and the plurality of second stages is configured to provide the scan signals and the sensing signals to the second region, wherein a configuration of the plurality of first stages is different from a configuration of the plurality of second stages in that at least two stages of the plurality of second stages share one selective sensing input circuit.

2. The OLED display device of claim 1, wherein the first region is a degradation vulnerable region having a relatively high degradation degree, and wherein the second region is a normal region having a relatively low degradation degree.

3. The OLED display device of claim 1, wherein the first region is an upper region or a lower region of the display panel, and wherein the second region is a middle region between the upper region and the lower region of the display panel.

4. The OLED display device of claim 1, wherein each of a plurality of pixels included in the first and second regions includes:

a capacitor including a first electrode coupled to a gate node, and a second electrode coupled to a source node;

a first transistor which generates a driving current based on a voltage stored in the capacitor;

a second transistor which couples a data line to the gate node in response to a corresponding one of the scan signals;

a third transistor which couples a sensing line to the source node in response to a corresponding one of the sensing signals; and an OLED which emits light based on the driving current.

5. The OLED display device of claim 1, wherein, in a sensing period of each frame period, a sensing operation for each pixel of the first region is performed, and a sensing operation for one pixel among N*M pixels of the second region is performed, wherein N is an integer greater than 1, and M is an integer greater than 0.

6. The OLED display device of claim 1, wherein each frame period includes an active period and a sensing period, wherein, in the active period, the plurality of first stages and the plurality of second stages provide the scan signals and the sensing signals to all of pixel rows of the first region and all of pixel rows of the second region, and wherein, in the sensing period, the plurality of first stages provides the scan signals and the sensing signals to all of the pixel rows of the first region, and the plurality of second stages provides the scan signals and the sensing signals to only a portion of the pixel rows of the second region.

7. The OLED display device of claim 6, wherein, in the sensing period, the plurality of second stages provides the scan signals and the sensing signals to one pixel row per N pixel rows of the second region, wherein N is an integer greater than 1.

8. The OLED display device of claim 1, wherein two stages of the plurality of first stages share one selective sensing input circuit, and wherein 2N stages of the plurality of second stages share one selective sensing input circuit, wherein N is an integer greater than 1.

9. The OLED display device of claim 1, wherein each of the plurality of first stages and the plurality of second stages includes:

a control node input circuit which transfers a first previous carry signal to a control node in response to the first previous carry signal, and transfers a low voltage to the control node in response to a next carry signal;

an inverter circuit which performs an inverting operation such that the control node and an inverted control node have opposite voltages;

a carry output circuit which outputs a carry signal based on a voltage of the control node and a carry clock signal;

a sensing output circuit which outputs a corresponding one of the sensing signals based on the voltage of the control node and a sensing clock signal;

a scan output circuit which outputs a corresponding one of the scan signals based on the voltage of the control node and a scan clock signal; and a selective sensing circuit which transfers a high voltage to the control node based on a sensing start signal and a voltage of a selective sensing input node, wherein two stages of the plurality of first stages further include one selective sensing input circuit which provides a second previous carry signal to the selective sensing input nodes of the two stages, and wherein 2N stages of the plurality of second stages further include one selective sensing input circuit which provides a third previous carry signal to the selective sensing input nodes of the 2N stages, and N is an integer greater than 1.

10. The OLED display device of claim 1, wherein two stages of the plurality of first stages share one selective sensing input circuit, wherein the scan driver further includes an extension switch which couples selective sensing input nodes of 2N stages of the plurality of second stages to each other in response to an extension signal, and N is an integer greater than 1, and wherein the 2N stages of the plurality of second stages share one selective sensing input circuit via the extension switch.

11. The OLED display device of claim 1, wherein each of the plurality of first stages includes one selective sensing input circuit, and wherein N stages of the plurality of second stages share one selective sensing input circuit, and N is an integer greater than 1.

12. The OLED display device of claim 1, wherein each of the plurality of first stages and the plurality of second stages includes:

a control node input circuit which transfers a first previous carry signal to a control node in response to the first previous carry signal, and transfers a low voltage to the control node in response to a next carry signal;

an inverter circuit which performs an inverting operation such that the control node and an inverted control node have opposite voltages;

a carry output circuit which outputs a carry signal based on a voltage of the control node and a carry clock signal;

a sensing output circuit which outputs a corresponding one of the sensing signals based on the voltage of the control node and a sensing clock signal;

a scan output circuit which outputs a corresponding one of the scan signals based on the voltage of the control node and a scan clock signal; and a selective sensing circuit which transfers a high voltage to the control node based on a sensing start signal and a voltage of a selective sensing input node, wherein each of the plurality of first stages further includes one selective sensing input circuit which provides a second previous carry signal to the selective sensing input node of the first stage, and wherein N stages of the plurality of second stages further include one selective sensing input circuit which provides a third previous carry signal to the selective sensing input nodes of the N stages, and N is an integer greater than 1.

13. The OLED display device of claim 1, wherein each of the plurality of first stages includes one selective sensing input circuit, wherein the scan driver further includes an extension switch which couples selective sensing input nodes of N stages of the plurality of second stages to each other in response to an extension signal, and N is an integer greater than 1, and wherein the N stages of the plurality of second stages share one selective sensing input circuit via the extension switch.

14. An organic light emitting diode (OLED) display device comprising:

a display panel including a first region and a second region; and a scan driver including a plurality of first stages and a plurality of second stages which are coupled to each other, wherein the plurality of first stages is configured to provide scan signals and sensing signals to the first region, and the plurality of second stages is configured to provide the scan signals and the sensing signals to the second region, wherein two stages of the plurality of first stages share one selective sensing input circuit, wherein 2N stages of the plurality of second stages share one selective sensing input circuit, and N is an integer greater than 1, wherein, in a sensing period of each frame period, a sensing operation for each pixel of the first region is performed, and a sensing operation for one pixel among N*M pixels of the second region is performed, and wherein N is an integer greater than 1, and M is an integer greater than 0.

15. The OLED display device of claim 14, wherein the first region is a degradation vulnerable region having a relatively high degradation degree, and wherein the second region is a normal region having a relatively low degradation degree.

16. The OLED display device of claim 14, wherein the first region is an upper region or a lower region of the display panel, and wherein the second region is a middle region between the upper region and the lower region of the display panel.

17. An organic light emitting diode (OLED) display device comprising:

a display panel including a first region and a second region; and a scan driver including a plurality of first stages and a plurality of second stages which are coupled to each other, wherein the plurality of first stages is configured to provide scan signals and sensing signals to the first region, and the plurality of second stages is configured to provide the scan signals and the sensing signals to the second region, wherein each of the plurality of first stages includes one selective sensing input circuit, and wherein N stages of the plurality of second stages share one selective sensing input circuit, and N is an integer greater than 1.

18. The OLED display device of claim 17, wherein the first region is a degradation vulnerable region having a relatively high degradation degree, and wherein the second region is a normal region having a relatively low degradation degree.

19. The OLED display device of claim 17, wherein the first region is an upper region or a lower region of the display panel, and wherein the second region is a middle region between the upper region and the lower region of the display panel.

* * * * *